US008737874B2

(12) United States Patent
Abe

(10) Patent No.: US 8,737,874 B2
(45) Date of Patent: May 27, 2014

(54) SHAFT-RECEIVING DEVICE, DRUM UNIT, AND IMAGE-FORMING DEVICE

(75) Inventor: Koji Abe, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 133 days.

(21) Appl. No.: 13/351,490

(22) Filed: Jan. 17, 2012

(65) Prior Publication Data

US 2012/0230729 A1 Sep. 13, 2012

(30) Foreign Application Priority Data

Mar. 8, 2011 (JP) ..... 2011-050406

(51) Int. Cl.
*G03G 15/00* (2006.01)

(52) U.S. Cl.
USPC ..... 399/117

(58) Field of Classification Search
USPC ..... 399/117
See application file for complete search history.

(56) References Cited

U.S. PATENT DOCUMENTS

| | | | | |
|---|---|---|---|---|
| 4,806,025 | A * | 2/1989 | Kamiyama et al. | 384/202 |
| 5,024,540 | A * | 6/1991 | Dreier et al. | 384/203 |
| 5,360,274 | A * | 11/1994 | Strobl | 384/192 |
| 6,376,952 | B1 * | 4/2002 | Stenta | 310/90 |
| 6,710,485 | B2 * | 3/2004 | Steuer et al. | 310/89 |
| 7,412,197 | B2 | 8/2008 | Jang | |
| 7,599,645 | B2 | 10/2009 | Hara et al. | |
| 7,627,268 | B2 | 12/2009 | Katoh et al. | |
| 7,769,318 | B2 | 8/2010 | Okabe | |
| 8,326,179 | B2 | 12/2012 | Hashimoto | |
| 8,626,024 | B2 | 1/2014 | Wu et al. | |
| 2003/0059233 | A1 | 3/2003 | Jang et al. | |
| 2004/0146230 | A1 * | 7/2004 | Lau | 384/420 |
| 2007/0002122 | A1 * | 1/2007 | Murano et al. | 347/115 |
| 2007/0003321 | A1 | 1/2007 | Hara et al. | |
| 2007/0036582 | A1 | 2/2007 | Okabe | |
| 2007/0098468 | A1 | 5/2007 | Jang | |
| 2007/0127955 | A1 * | 6/2007 | Katoh et al. | 399/302 |

(Continued)

FOREIGN PATENT DOCUMENTS

| | | | |
|---|---|---|---|
| CN | 1104570 | C | 4/2003 |
| CN | 1959562 | A | 5/2007 |

(Continued)

OTHER PUBLICATIONS

European Search Report for corresponding European Patent Application No. 12151207.3 dated Jul. 18, 2012.

(Continued)

*Primary Examiner* — G. M. Hyder
(74) *Attorney, Agent, or Firm* — Banner & Witcoff, Ltd.

(57) ABSTRACT

A shaft-receiving device connects a rotating member and a frame. The rotating member has a rotational axis extending in a first direction and at least one end in the first direction. The frame extends in a second direction perpendicular to the first direction and is formed with a through-hole having an inner peripheral surface. The shaft-receiving device includes a shaft-receiving portion and a pressing member. The one end is inserted into the shaft-receiving portion in the first direction. The shaft-receiving portion is inserted into the through-hole in the first direction and opposes the inner peripheral surface in the second direction. The pressing member opposes the inner peripheral surface in the second direction to press the rotating member toward the inner peripheral surface.

20 Claims, 18 Drawing Sheets

(56) References Cited

U.S. PATENT DOCUMENTS

| | | | | |
|---|---|---|---|---|
| 2009/0218472 | A1 | 9/2009 | Takemoto | |
| 2010/0040392 | A1* | 2/2010 | Wu et al. | 399/53 |
| 2010/0135697 | A1* | 6/2010 | Hashimoto | 399/117 |
| 2010/0266312 | A1 | 10/2010 | Okabe | |
| 2011/0064462 | A1 | 3/2011 | Abe et al. | |

FOREIGN PATENT DOCUMENTS

| | | | |
|---|---|---|---|
| CN | 1983063 | A | 6/2007 |
| CN | 100524068 | C | 8/2009 |
| CN | 101587323 | A | 11/2009 |
| EP | 1 804 141 | | 7/2007 |
| JP | 05-180217 | A | 7/1993 |
| JP | 2007-072422 | | 3/2007 |
| JP | 2007-328204 | A | 12/2007 |
| JP | 2008-095761 | A | 4/2008 |
| JP | 2010-128341 | A | 6/2010 |
| JP | 2011-064884 | | 3/2011 |
| WO | 0106140 | A1 | 1/2001 |

OTHER PUBLICATIONS

Office Action issued in corresponding Japanese Patent Application No. 2011-050406 mailed Mar. 19, 2013.

Office Action issued in corresponding European Patent Application No. 12151207.3 mailed Jun. 5, 2013.

Extended European Search Report issued in corresponding European Patent Application No. 12151207.3 dated Sep. 14, 2012.

Office Action issued in corresponding Chinese Patent Application No. 201210024665.7 dated Jan. 21, 2014.

* cited by examiner

SHAFT-RECEIVING DEVICE, DRUM UNIT, AND IMAGE-FORMING DEVICE

CROSS REFERENCE TO RELATED APPLICATION

This application claims priority from Japanese Patent Application No. 2011-050406 filed Mar. 8, 2011. The entire content of this application is incorporated herein by reference.

TECHNICAL FIELD

The present invention relates to a shaft-receiving device, a drum unit equipped with the shaft-receiving device, and an image-forming device equipped with the drum unit.

BACKGROUND

One electrophotographic color printer well known in the art is a tandem-type color printer. This printer has four photosensitive drums corresponding to the colors yellow, magenta, cyan, and black and arranged in tandem and parallel to one another.

One such tandem color printer proposed in Japanese unexamined patent application publication No. 2007-72422 has a main casing, and four photosensitive drums that are detachably mounted as a unit in the main casing. This conventional color printer is provided with drum subunits for holding the photosensitive drums, and a pair of side plates disposed on both sides of the drum subunits with respect to the axial direction of the photosensitive drums. A developer cartridge is provided for each of the drum subunits. The developer cartridges each hold a developing roller and are detachably mounted between the side plates. The drum subunits, developer cartridges, and side plates are all detachably mounted in the main casing as a drum unit.

SUMMARY

It is an object of the present invention to provide a shaft-receiving device, drum unit, and image-forming device capable of positioning rotary members, such as photosensitive drums, relative to a frame with precision.

In order to attain the above and other objects, the invention provides a shaft-receiving device for connecting a rotating member and a frame, the rotating member having a rotational axis extending in a first direction and at least one end in the first direction, the frame extending in a second direction perpendicular to the first direction and being formed with a through-hole having an inner peripheral surface. The shaft-receiving device includes: a shaft-receiving portion into which the one end is inserted in the first direction, the shaft-receiving portion being inserted into the through-hole in the first direction and opposing the inner peripheral surface in the second direction; and a pressing member opposing the inner peripheral surface in the second direction to press the rotating member toward the inner peripheral surface.

According to another aspect, the present invention provides a drum unit includes: a photosensitive drum having a rotational axis extending in a first direction and at least one end in the first direction; a frame extending in a second direction perpendicular to the first direction and being formed with a through-hole having an inner peripheral surface; a shaft-receiving device including: a shaft-receiving portion into which the one end is inserted in the first direction, the shaft-receiving portion being inserted into the through-hole in the first direction and opposing the inner peripheral surface in the second direction; and a pressing member opposing the inner peripheral surface in the second direction to press the photosensitive drum toward the inner peripheral surface.

According to another aspect, the present invention provides an image-forming device includes: a photosensitive drum having a rotational axis extending in a first direction and at least one end in the first direction; a frame extending in a second direction perpendicular to the first direction and being formed with a through-hole having an inner peripheral surface; and a shaft-receiving device including: a shaft-receiving portion into which the one end is inserted in the first direction, the shaft-receiving portion being inserted into the through-hole in the first direction and opposing the inner peripheral surface in the second direction; and a pressing member opposing the inner peripheral surface in the second direction to press the photosensitive drum toward the inner peripheral surface.

BRIEF DESCRIPTION OF THE DRAWINGS

The particular features and advantages of the invention as well as other objects will become apparent from the following description taken in connection with the accompanying drawings, in which.

DETAILED DESCRIPTION

Next, preferred embodiments of the present invention will be described while referring to the accompanying drawings.

1. Printer

Figure 1:
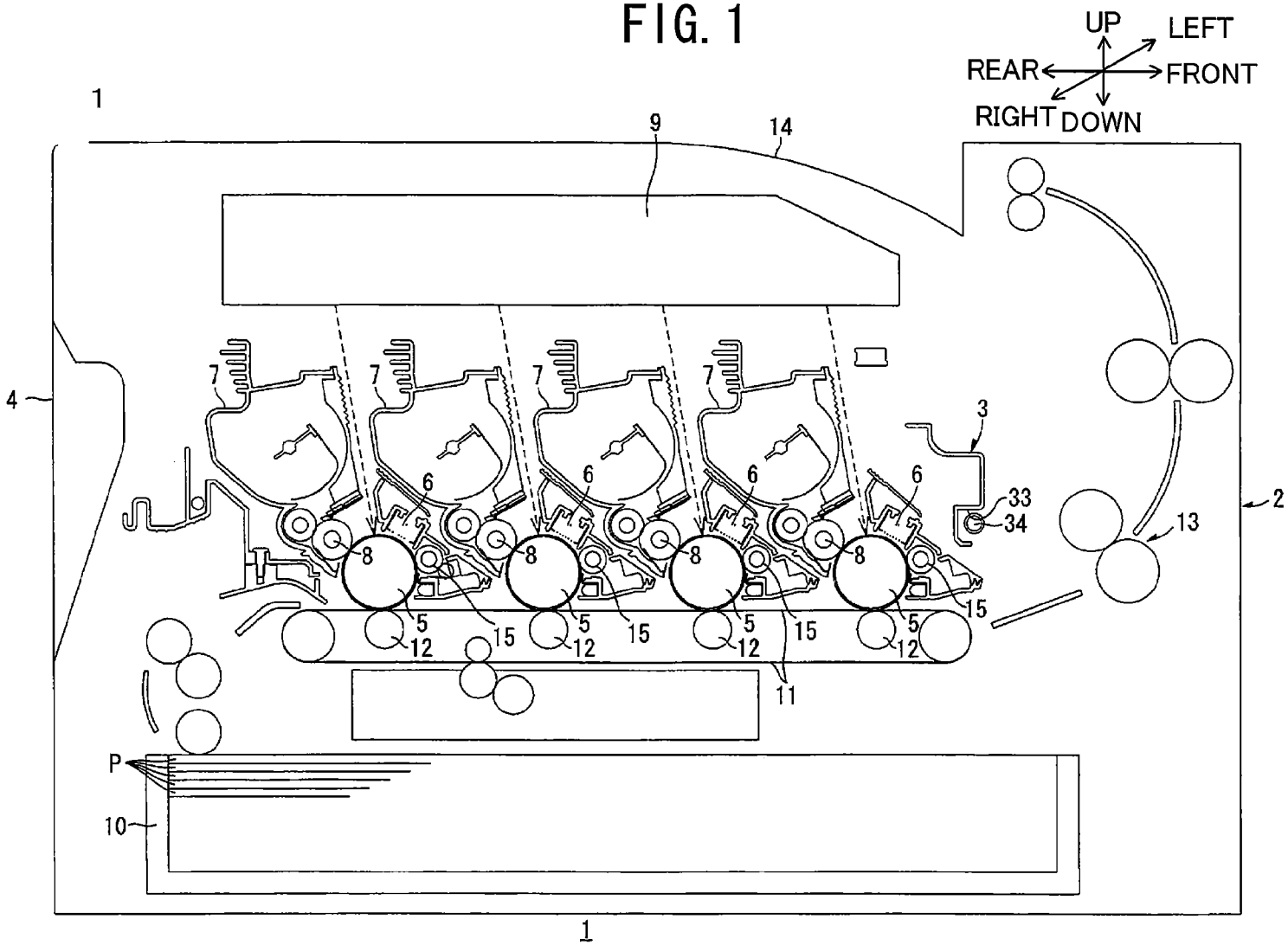
FIG. 1 is a center cross-sectional view of a color printer according to a first embodiment of the present invention.

The image-forming device of the preferred embodiments is a tandem color printer 1. As shown in FIG. 1, the printer 1 includes a main casing 2, and a drum unit 3 mounted in the main casing 2. A cover 4 is provided on the front surface of the main casing 2. By opening the cover 4, the drum unit 3 can be mounted in or removed from the main casing 2.

In the following description, the side of the main casing 2 on which the cover 4 is provided (the left side in FIG. 1) will be referred to as the "front side," while the opposite side (the right side in FIG. 1) will be referred to as the "rear side." The left and right sides of the main casing 2 will be based on the perspective of a user facing the front side of the printer 1.

The drum unit 3 is provided with four photosensitive drums 5 corresponding to the four colors black, yellow, magenta, and cyan. The photosensitive drums 5 are arranged parallel to each other and are spaced at equal intervals in the front-to-rear direction in the order black, yellow, magenta, and cyan.

The drum unit 3 also includes a Scorotron charger 6 and a developer cartridge 7 for each of the photosensitive drums 5. Each developer cartridge 7 includes a developing roller 8 for supplying toner to the corresponding photosensitive drum 5. The developer cartridges 7 are detachably mounted in the drum unit 3.

An exposure device 9 is disposed above the drum unit 3 for irradiating four laser beams corresponding to the four colors employed in the printer 1.

In an image-forming operation, the chargers 6 apply a uniform charge to the surfaces of the corresponding photosensitive drums 5 through corona discharge, as the photosensitive drums 5 rotate. Subsequently, the exposure device 9 irradiates laser beams for selectively exposing the surfaces of the photosensitive drums 5. Each laser beam selectively removes charge from the surface of the corresponding photosensitive drum 5, forming an electrostatic latent image thereon. As the electrostatic latent image formed on the charger 6 rotates to a position opposite the corresponding developing roller 8, the developing roller 8 supplies toner to the latent image, developing the latent image into a visible toner image on the surface of the photosensitive drum 5.

Here, four LED arrays may be provided for the four photosensitive drums 5 in place of the exposure device 9.

A paper cassette 10 accommodating sheets of a paper P is disposed in the bottom section of the main casing 2. The paper P accommodated in the paper cassette 10 is conveyed onto a conveying belt 11 by various rollers. The conveying belt 11 is positioned so as to confront the four photosensitive drums 5 from below. Four transfer rollers 12 are disposed inside the loop formed by the conveying belt 11 at positions confronting each of the photosensitive drums 5 through the upper portion of the conveying belt 11. When a sheet of paper P is conveyed onto the conveying belt 11, the conveying belt 11 conveys the sheet sequentially through positions between the conveying belt 11 and each of the photosensitive drums 5. As the sheet passes beneath each photosensitive drum 5, the toner image carried on the surface of the photosensitive drum 5 is transferred onto the paper P by a transfer bias applied to the corresponding transfer roller 12.

A fixing unit 13 is provided on the downstream side of the conveying belt 11 with respect to the direction in which the paper P is conveyed. After toner images are transferred onto a sheet of paper P, the sheet is conveyed to the fixing unit 13, where the toner images are fixed to the sheet by heat and pressure. After the toner images are fixed in the fixing unit 13, various rollers discharge the sheet onto a discharge tray 14 formed on the top surface of the main casing 2.

2. Drum Unit

Figure 2:
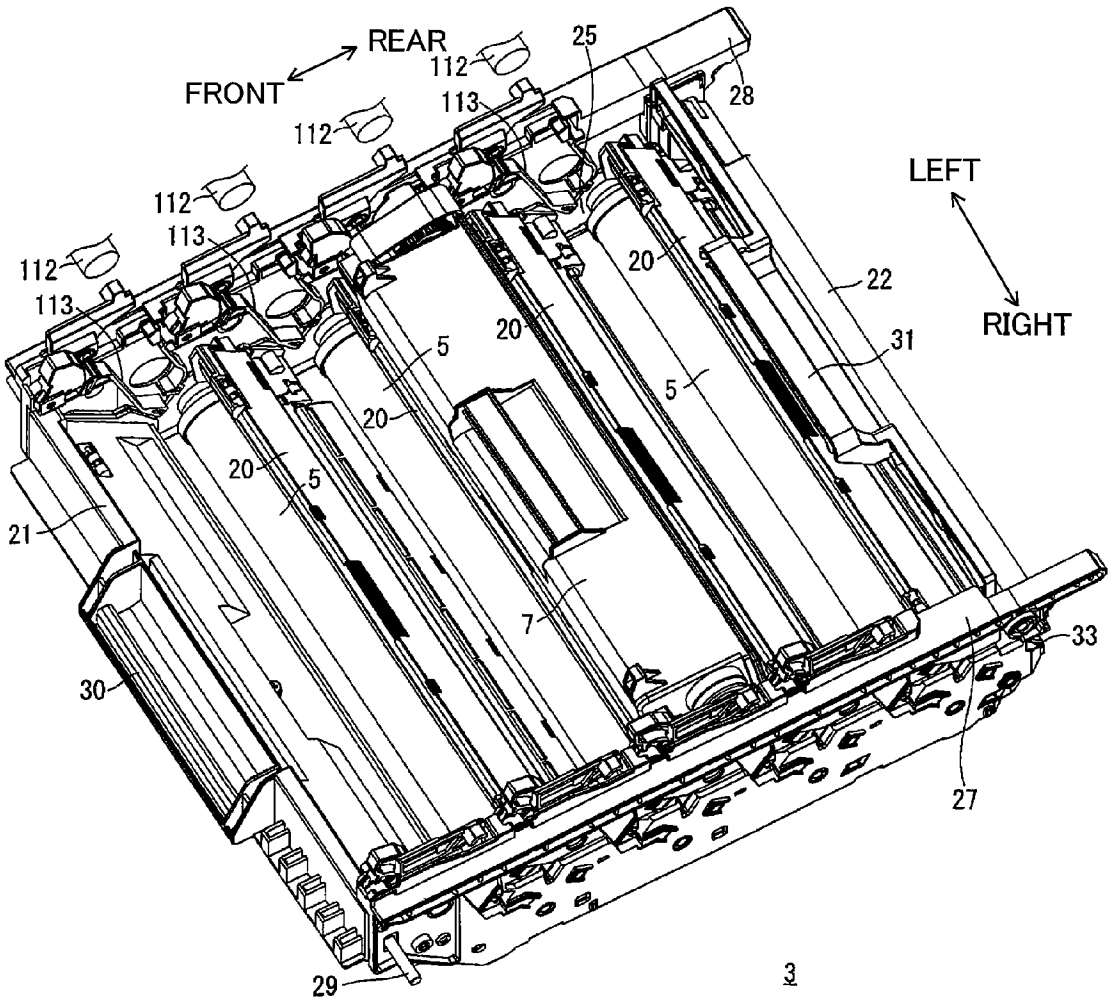
FIG. 2 is a perspective view of a drum unit from an angle above and on the right front side thereof when only one developer cartridge is mounted in the drum unit.

As shown in FIG. 2, the drum unit 3 is an integrated unit that includes the four photosensitive drums 5, the four developer cartridges 7, four drum subunits 20, a front beam 21, a rear beam 22, a pair of left and right inner plates 24 and 25 (see also FIG. 3), and a pair of left and right outer plates 27 and 28. The drum unit 3 is mounted in the main casing 2 (see FIG. 1) and is slidably inserted into and removed therefrom.

(1) Drum Subunits

The four drum subunits 20 are disposed at intervals in the front-to-rear direction between the left and right inner plates 24 and 25. Each drum subunit 20 is molded of a synthetic resin. The drum subunit 20 is shaped substantially like a triangular prism elongated in the left-to-right direction with an opening on the lower front side. Each drum subunit 20 functions to hold the charger 6, and a cleaning member 15 shown in FIG. 1 for cleaning the surface of the corresponding photosensitive drum 5.

(2) Front Beam

The front beam 21 is formed of a synthetic resin material and bridges the front end parts of the left and right inner plates 24 and 25.

The front beam 21 holds a support shaft 29. The support shaft 29 penetrates the front beam 21, as well as the left and right inner plates 24 and 25, and the left and right outer plates 27 and 28 in the left-to-right direction and protrudes outward from the left and right outer plates 27 and 28.

A front handle 30 is integrally formed on the front surface of the front beam 21 at a position in the left-to-right center of the same. The front handle 30 is substantially U-shaped in a plan view, with both ends of the handle coupled to the front beam 21.

(3) Rear Beam

The rear beam 22 is also formed of a synthetic resin material and bridges the rear end parts of the left and right inner plates 24 and 25.

A rear handle 31 is integrally formed on the top surface of the rear beam 22 at a position in the left-to-right center of the same. The rear handle 31 is substantially U-shaped in a rear side view, with both ends of the handle coupled to the rear beam 22. The rear handle 31 protrudes upward from the rear beam 22 with a forward slope from bottom to top.

(4) Inner Plates

The left and right inner plates 24 and 25 are produced in a sheet-metal stamping process using the same die and, hence, have the same shape. Only the structure of the left inner plate 25 is described below, but the right inner plate 24 has the same structure.

Figure 3:
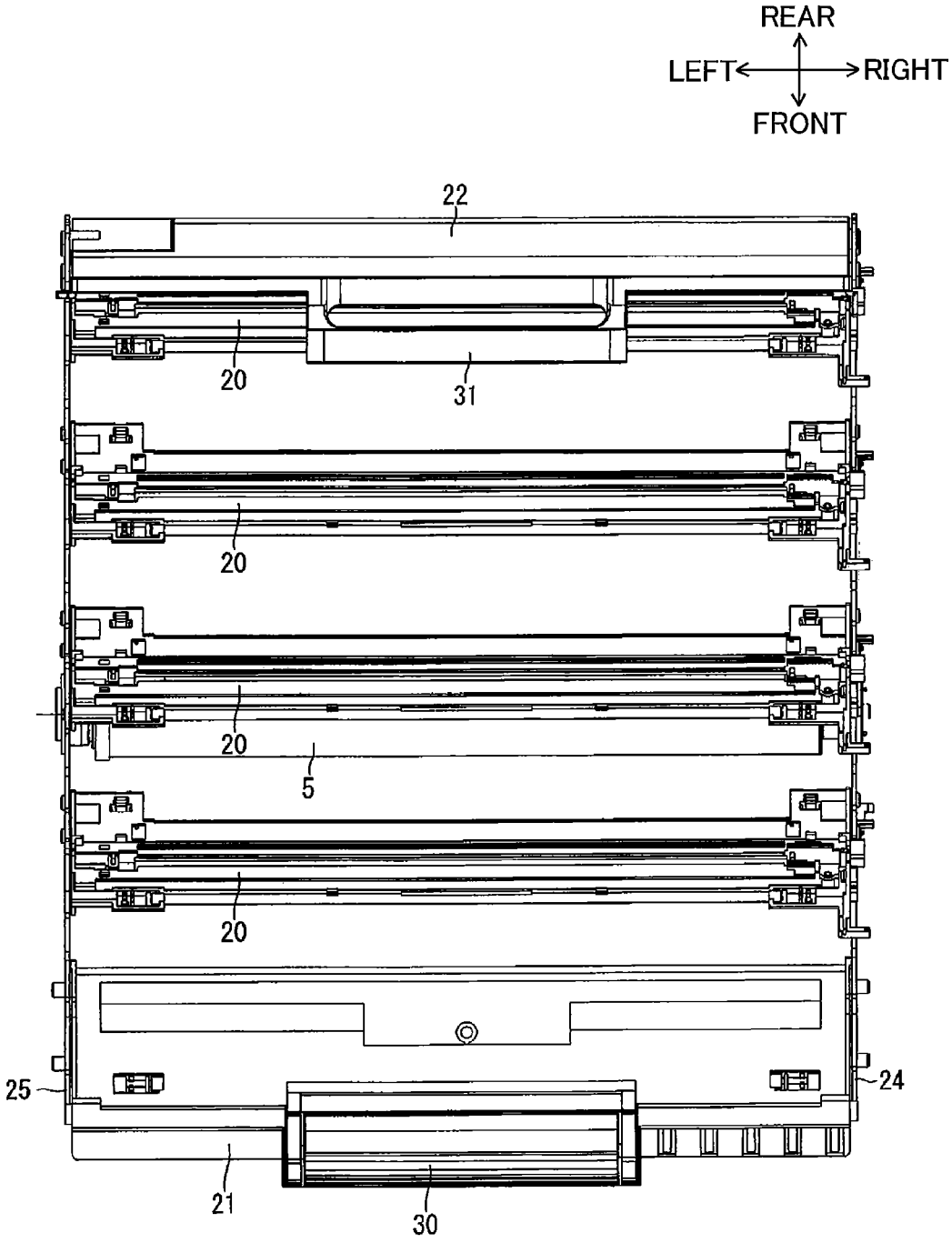
FIG. 3 is a plan view of the drum unit when the pair of outer plates has been removed from the drum unit.
Figure 4:
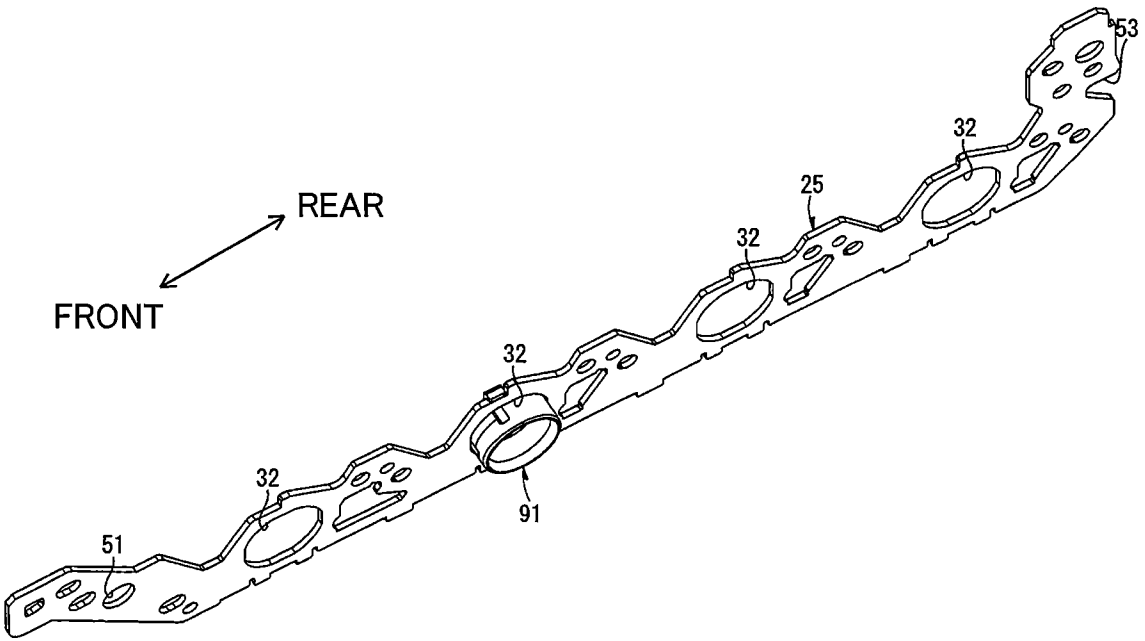
FIG. 4 is a perspective view of a left inner plate from an angle above and on the right front side thereof.

As shown in FIGS. 3 and 4, the left inner plate 25 has a substantially elongated rectangular shape and extends in the front-to-rear direction. The front and rear ends of the left inner plate 25 respectively confront the front beam 21 and rear beam 22 in the left-to-right direction.

The front end of the left inner plate 25 extends along an upward slant toward the front. A support shaft insertion hole 51 for inserting the support shaft 29 is formed in this front end part of the left inner plate 25.

The rear end of the left inner plate 25 is substantially L-shaped in a side view. A positioning part 53 is formed in the rear end of the left inner plate 25 as a generally V-shaped notch in the rear edge thereof. As shown in FIG. 1, the positioning part 53 receives a main casing reference shaft 34 spanning between rear sides of the main casing 2 in the left-to-right direction when the drum unit 3 is mounted in the main casing 2. The positioning part 53 contacts the main casing reference shaft 34 from the front and top.

Four drum support holes 32 are formed in the left inner plate 25 at regular intervals in the front-to-rear direction.

(4-1) Drum Support Holes

Figure 5:
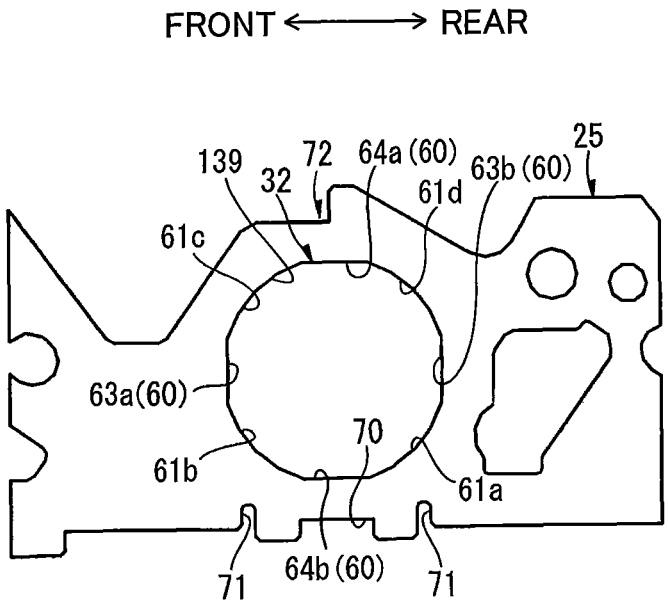
FIG. 5 is an enlarged view showing a portion of the left inner plate around a drum support hole.

As shown in FIG. 5, each drum support hole 32 has an inner peripheral surface 139 configured of four straight parts 60 and four curved parts 61*a*-61*d*.

The four straight parts 60 are configured of a front vertical straight part 63*a* and a rear vertical straight part 63*b* that extend vertically and oppose each other in the front-to-rear direction, and a top horizontal straight part 64*a* and a bottom horizontal part 64*b* that extend in the front-to-rear direction and oppose each other vertically. The rear vertical straight part 63*b* and the bottom horizontal straight part 64*b* are used to position a flange member 81 of the photosensitive drum 5 described later.

The four curved parts 61*a*-61*d* connect pairs of orthogonal straight parts 60 so that the corners between the orthogonal straight parts 60 are rounded. In a side view, the drum support hole 32 appears generally square in shape with rounded vertices. As described later, the four straight parts 60 are formed to fix the shaft-receiving member 90, and the four curved parts 61*a*-61*d* are formed to accept the thermal extension of the right and left inner plates 24 and 25.

(4-2) Engaging Grooves

A shaft-receiving engaging groove 70 is formed in the bottom edge of the left inner plate 25 at a position vertically aligned with the center of each drum support hole 32. The shaft-receiving engaging groove 70 is a substantially rectangular groove that is recessed upward in the bottom edge. Clip grooves 71 are also formed in the bottom edge of the left inner plate 25 on the front and rear side of each shaft-receiving engaging groove 70. The clip grooves 71 are substantially rectangular in shape and are recessed upward in the bottom edge.

Above each drum support hole 32, the top edge of the left inner plate 25 slopes upward toward the front, drops downward at a position opposing the center of the corresponding drum support hole 32, and then extends forward substantially parallel to the horizontal straight parts 64*a* and 64*b*. This configuration forms a step part in the top edge of the left inner plate 25 above each drum support hole 32. The lower level of each step part is an engagement part 72. The engagement part 72 is engaged by a first engaging part 101 (or a second engaging part 110) of a right shaft-receiving member 90 (or a left shaft-receiving member 91) described later.

(5) Outer Plates

The left and right outer plates 27 and 28 shown in FIG. 2 are formed of fiber-reinforced resin, for example. The left and right outer plates 27 and 28 have a substantially elongated rectangular plate shape in a side view. Compared to the left and right inner plates 24 and 25, the left and right outer plates 27 and 28 have a wider vertical dimension and about the same front-to-rear length. The front and rear end parts of the left and right outer plates 27 and 28 confront the front beam 21 and rear beam 22 in respective left and right directions.

The front ends of the left and right outer plates 27 and 28 have bottom edges that slope upward toward the front, forming a narrower vertical dimension than the midway parts of the same plates. The rear ends of the left and right outer plates 27 and 28 have lower edges that slope upward toward the rear, forming narrower vertical dimensions that the midway parts of the same plates.

A recessed part 33 is formed in the rear end of each of the left and right outer plates 27 and 28. The recessed parts 33 have substantially the same shape as the positioning parts 53 formed in the left and right inner plates 24 and 25 (see FIG. 4) and are formed at positions corresponding to the positioning parts 53 in the left-to-right direction. The recessed parts 33 do not interfere with the main casing reference shaft 34 when the drum unit 3 is mounted in the main casing 2.

(6) Photosensitive Drums

Figure 6:
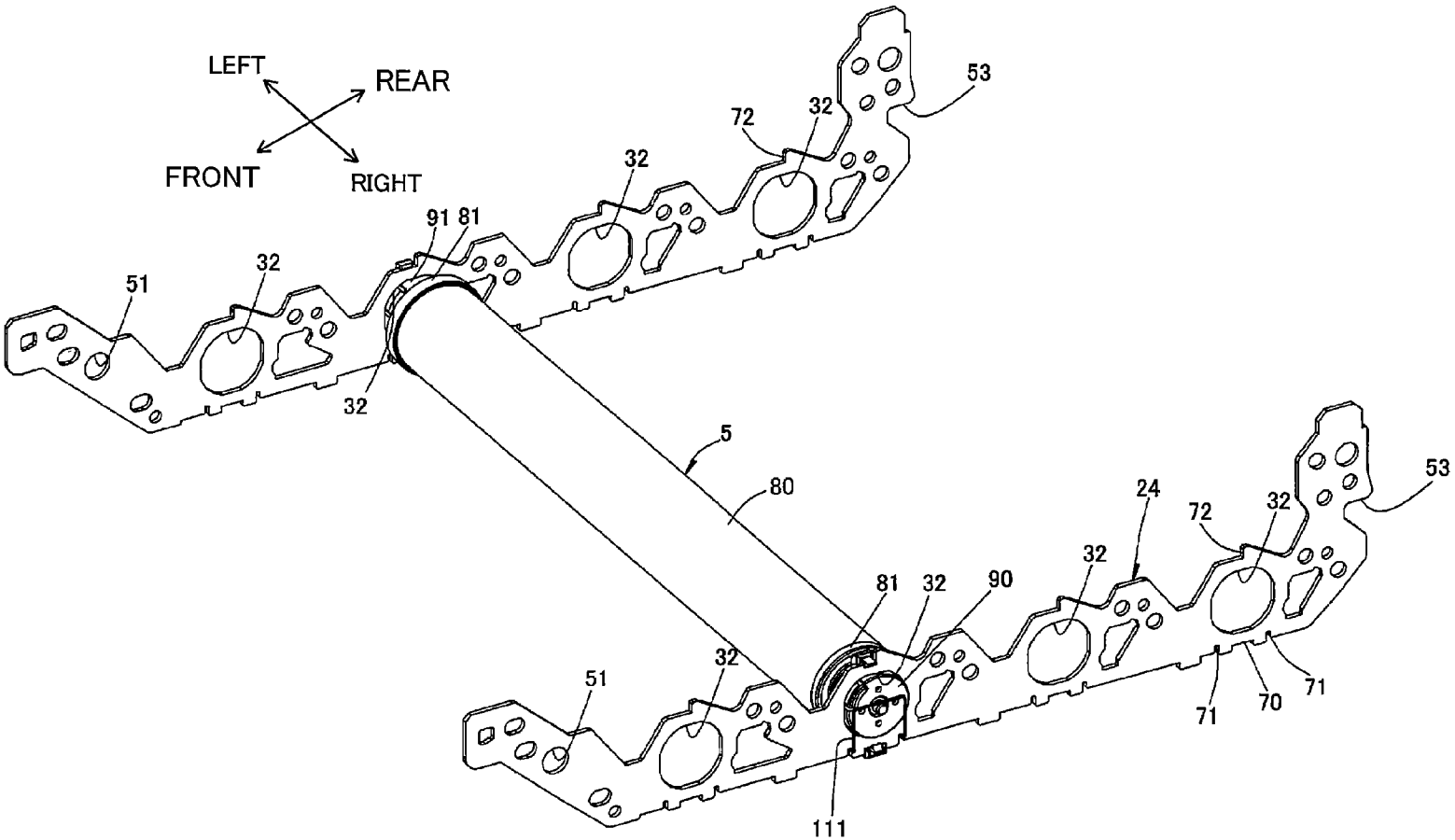
FIG. 6 is a perspective view showing a single photosensitive drum mounted in left and right inner plates.

As shown in FIG. 6, each photosensitive drum 5 is provided with a cylindrical main drum body 80, and two flange members 81. One of the flange members 81 is fitted over each end of the main drum body 80 so as to be incapable of rotating relative to the main drum body 80.

The outer surface of the main drum body 80 is formed of a positive-charging photosensitive layer.

The flange members 81 are formed of a synthetic resin material. When fitted into the ends of the main drum body 80, a portion of the flange members 81 is inserted into the main drum body 80. Drive transmission parts 112 (described later with reference to FIG. 2) provided in the main casing 2 are coupled to the left endfaces of the left flange member 81 through coupling grooves (not shown). With this construction, a drive force can be transmitted through the drive transmission parts 112 to the photosensitive drum 5 for driving the photosensitive drum 5 to rotate when the drum unit 3 is mounted in the main casing 2, as shown in FIG. 1. The outer ends of the flange members 81 have an outer diameter that is smaller than the diameter of the drum support holes 32 formed in the left and right inner plates 24 and 25.

The right flange member 81 is rotatably supported in the right inner plate 24 by a right shaft-receiving member 90. The left flange member 81 is rotatably supported in the left inner plate 25 by a left shaft-receiving member 91.

(7) Shaft-Receiving Members (7-1) Right Shaft-Receiving Member

Figure 7:
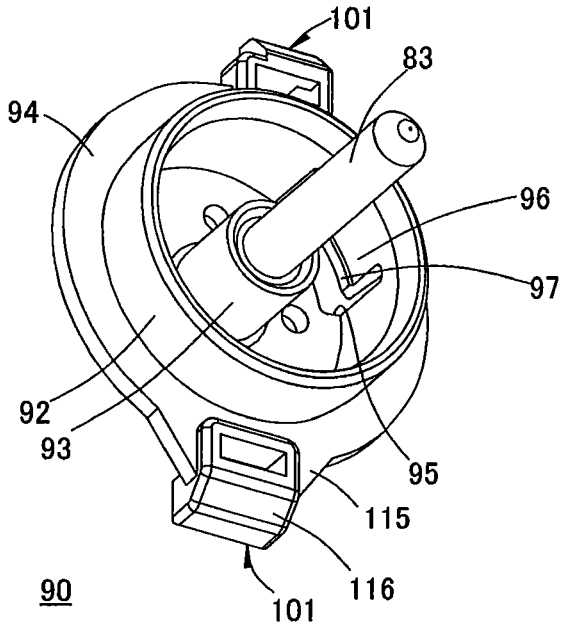
FIG. 7 is a perspective view of a right shaft-receiving member.
Figure 8A:
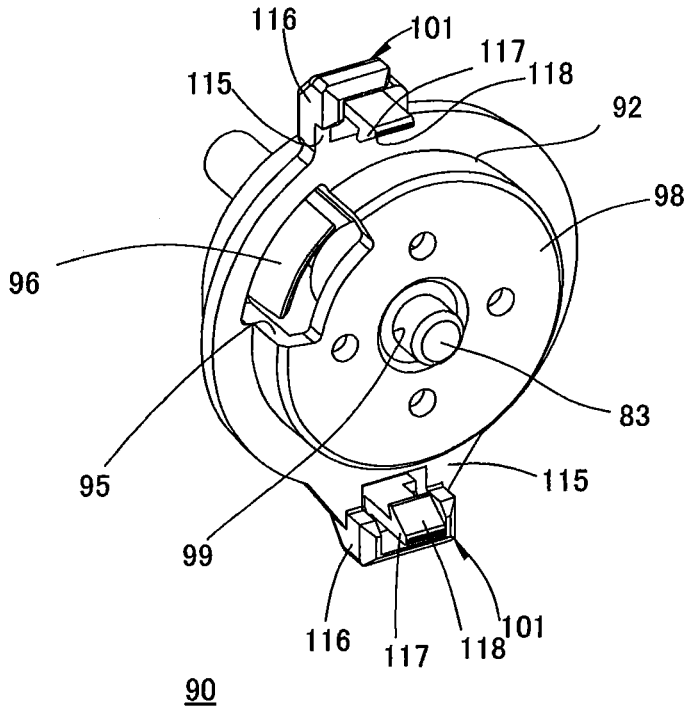
FIG. 8A is a perspective view of a right shaft-receiving member.
Figure 8B:
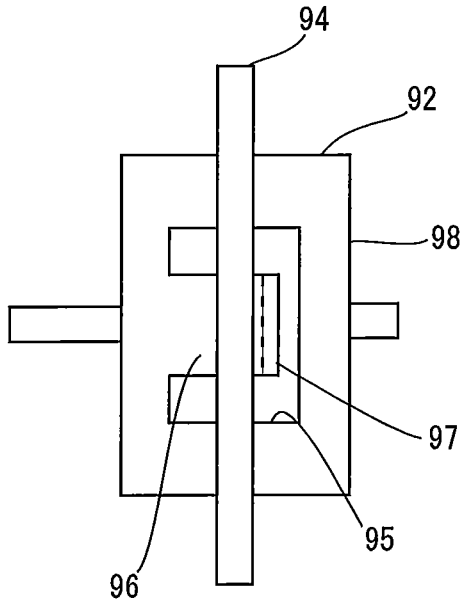
FIG. 8B is a side view of the right shaft-receiving member.

The shaft-receiving member 90 is formed of a synthetic resin material. As shown in FIGS. 7, 8A and 8B, the right shaft-receiving member 90 is integrally configured of a cylinder part 92 having a cylindrical shape, a seal part 98 for sealing one endface of the cylinder part 92, a shaft retaining part 93 disposed on the center part of the seal part 98 within the space encircled by the cylinder part 92 and formed with a cylindrical shape concentric to the cylinder part 92, and a collar part 94 shaped like an annular disc surrounding the peripheral surface of the cylinder part 92 and extending radially outward from a midpoint of the cylinder part 92 relative to its axial direction.

The outer diameter of the cylinder part 92 is approximately the same as the inner peripheral surface 139 of the drum support hole 32 formed in the right inner plate 24 (see FIG. 4). The inner diameter of the cylinder part 92 is slightly larger than the outer peripheral diameter of the right flange members 81.

A notch part 95 is formed in the cylinder part 92. The notch part 95 is a cutout portion that extends along the circumferential direction of the cylinder part 92 on one axial side (the seal part 98 side), then from both circumferential ends of this cutout portion extends toward the other axial side of the cylinder part 92.

Put another way, the notch part 95 cutout in the cylinder part 92 includes a pair of slits separated by an arc length having a central angle of approximately 30 degrees and extending from one side of the cylinder part 92 (the seal part 98 side) toward the other side; and another slit providing communication between the first pair of slits in the circumferential direction of the cylinder part 92. The seal part 98 is also cut out radially inward with an arc length having a central angle of about 30 degrees so that the cutout portion of the seal part 98 is in communication with the slit cut out in the circumferential direction of the cylinder part 92.

The resulting notch part 95 forms a general U-shape in the cylinder part 92 and collar part 94 when viewed from the side, as shown in FIG. 8B.

The rectangular-shaped part that is surrounded by the generally U-shaped notch part 95 in a side view constitutes a pressing member 96. The pressing member 96 is elongated and curved in the circumferential direction and extends from the collar part 94 toward the seal part 98.

A protruding part 97 is also formed on the inner peripheral surface of the pressing member 96 at the end nearest the seal part 98. The protruding part 97 has a hook-shaped cross section (see FIG. 13).

The protruding part 97 protrudes inward from the inner peripheral surface of the pressing member 96 into the interior space of the cylinder part 92. When the right flange member 81 is inserted inside the cylinder part 92 of the right shaft-receiving member 90, the protruding part 97 contacts and applies pressure to the right flange member 81 (see FIG. 13).

A shaft insertion hole 99 is formed in the seal part 98. The shaft insertion hole 99 penetrates the seal part 98 in its thickness direction. The shaft insertion hole 99 is formed in the center portion of the seal part 98 and communicates with the interior of the shaft retaining part 93.

A rod-shaped shaft 83 is provided in the right shaft-receiving member 90 along the central axis of the cylinder part 92 (shaft retaining part 93). One end of the shaft 83 is inserted into the shaft retaining part 93, penetrating the shaft insertion hole 99 and protruding out from the seal part 98. The other end of the shaft 83 is tapered.

Two first engaging parts 101 are formed on the outer periphery of the collar part 94 at positions opposite each other across the axis of the shaft 83. Each first engaging part 101 is integrally configured of an extension part 115, a support part 116, and an engaging protrusion 117.

The extension part 115 has a U-shape in a side view, the U-shape opening outward from the outer peripheral edge of the collar part 94 along a radial direction of the cylinder part 92. The support part 116 has also a U-shape in a side view and covers the extension part 115.

The engaging protrusion 117 is provided on the side of the first engaging part 101 nearest the seal part 98. The engaging protrusion 117 passes out through the space defined by the U-shaped extension part 115 and support part 116 and protrudes out in a direction toward the seal part 98 side.

The distal end of the engaging protrusion 117 has a hook shape in cross section. A sloped surface 118 is formed on the distal end of the engaging protrusion 117. The sloped surface 118 slopes from the distal end of the engaging protrusion 117 toward the base end in a direction that approaches the central axis of the cylinder part 92. The gap formed between the edge of the sloped surface 118 on the base end side and the surface of the collar part 94 on the seal part 98 side is set approximately the same as the thickness of the right inner plate 24 in the left-to-right direction.

(7-2) Left Shaft-Receiving Member

Figure 9:
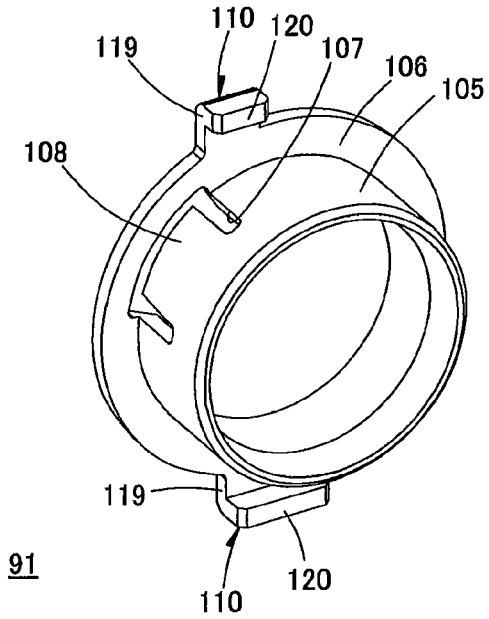
FIG. 9 is a perspective view of a left shaft-receiving member.
Figure 10:
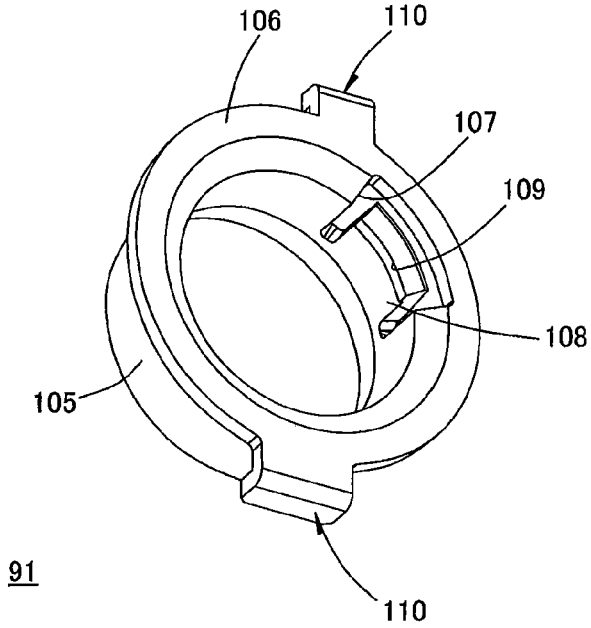
FIG. 10 is a perspective view of a left shaft-receiving member.

The left shaft-receiving member 91 is formed of a synthetic resin material. As shown in FIGS. 9 and 10, the left shaft-receiving member 91 is integrally configured of a cylinder part 105 having a cylindrical shape, and a collar part 106 formed on one circumferential edge of the cylinder part 105. The collar part 106 has an annular plate shape and expands radially outward.

The cylinder part 105 has an outer diameter approximately equivalent to the diameter of the drum support holes 32 formed in the left inner plate 25 (see FIG. 4) and an inner diameter slightly larger than the outer peripheral diameter of the left flange members 81.

A notch part 107 is formed in the cylinder part 105 as a cutout portion that extends along the circumferential direction of the cylinder part 105 on one axial side (the collar part 106 side), then from both circumferential ends of this cutout portion extends toward the other axial side of the cylinder part 105.

More specifically, the cylinder part 105 is cut out to form a pair of slits separated by an arc length having a central angle of approximately 30 degrees that extend from the collar part 106 side of the cylinder part 105 toward the other side, and another slit formed in the collar part 106 side of the cylinder part 105 that extends in the circumferential direction to provide communication between the first pair of slits. The notch part 107 is also formed with a cutout portion in the collar part 106 extending in a direction radially outward from the cylinder part 105 and having an arc length in the circumferential direction based on a central angle of approximately 30 degrees. The cutout portion in the collar part 106 is formed at a position for communicating with the circumferential cutout part formed in the cylinder part 105.

Accordingly, the notch part 107 formed in the cylinder part 105 and collar part 106 has a general U-shape in a side view.

The rectangular-shaped part of the cylinder part 105 that is surrounded by the U-shaped notch part 107 in a side view constitutes a pressing member 108. The pressing member 108 is elongated and curved in the circumferential direction and extends from a midway point of the cylinder part 105 in the axial direction toward the collar part 106 side.

A protruding part 109 is also formed on the inner peripheral surface of the pressing member 108 along the edge nearest the collar part 106. The protruding part 109 has a hook-like shape in cross section (see FIG. 14) and protrudes from the inner peripheral surface of the pressing member 108 into the internal space defined by the cylinder part 105. The protruding part 109 is also formed so as to contact and apply pressure to the left flange member 81 when the left flange member 81 is inserted inside the cylinder part 105 from the collar part 106 side (see FIG. 14).

Two second engaging parts 110 are formed on the outer periphery of the collar part 106 at positions opposite each other about the axis of the cylinder part 105. Each second engaging part 110 is integrally provided with an extension part 119, and an engaging protrusion 120.

The extension part 119 has a generally rectangular shape in a side view and extends outward from the outer peripheral edge of the collar part 106 along a radial direction of the cylinder part 105.

The engaging protrusion 120 is plate-shaped and extends from the distal end of the extension part 119 (the outer end with respect to the radial direction of the cylinder part 105) toward the opposite side of the cylinder part 105 from the collar part 106. Hence, together the extension part 119 and engaging protrusion 120 form an L-shape in cross section.

(8) Mounting the Photosensitive Drums in the Drum Unit

The photosensitive drums 5 are mounted in the drum unit 3 when the four drum subunits 20, the front beam 21, the rear beam 22, and the pair of left and right inner plates 24 and 25 have been assembled, as shown in FIG. 3.

To assemble the drum unit 3, the four drum subunits 20 are spaced at regular intervals in the front-to-rear direction. The drum subunit 20 is spaced in front of the frontmost drum subunit 20, and the rear beam 22 is spaced a slight interval rearward of the rearmost drum subunit 20.

Subsequently, the right inner plate 24 is disposed on the right side of the front beam 21, the four drum subunits 20, and the rear beam 22, while the left inner plate 25 is disposed on the left side of the same. Next, the left and right inner plates 24 and 25 are assembled to the front beam 21, the drum subunits 20, and the rear beam 22 with a plurality of screws (not shown).

After assembling the left and right inner plates 24 and 25 on the front beam 21, drum subunits 20, and rear beam 22, the photosensitive drums 5 can be mounted in this assembly.

First, the right shaft-receiving member 90 is mounted on the right end of a photosensitive drum 5. Specifically, the right flange member 81 is inserted inside the cylinder part 92 of the right shaft-receiving member 90. At this time, the protruding part 97 of the pressing member 96 formed on the cylinder part 92 elastically contacts the outer peripheral surface of the flange member 81, pressing the right flange member 81 away from the pressing member 96. Contrary, the pressing member 96 is pressed by the right flange member 81 and protrudes outward of the cylinder part 92 due to the resistance from the right flange member 81. With the right shaft-receiving member 90 fitted around the right flange member 81, the shaft 83 held in the shaft retaining part 93 is inserted inside the photosensitive drum 5.

Figure 11:
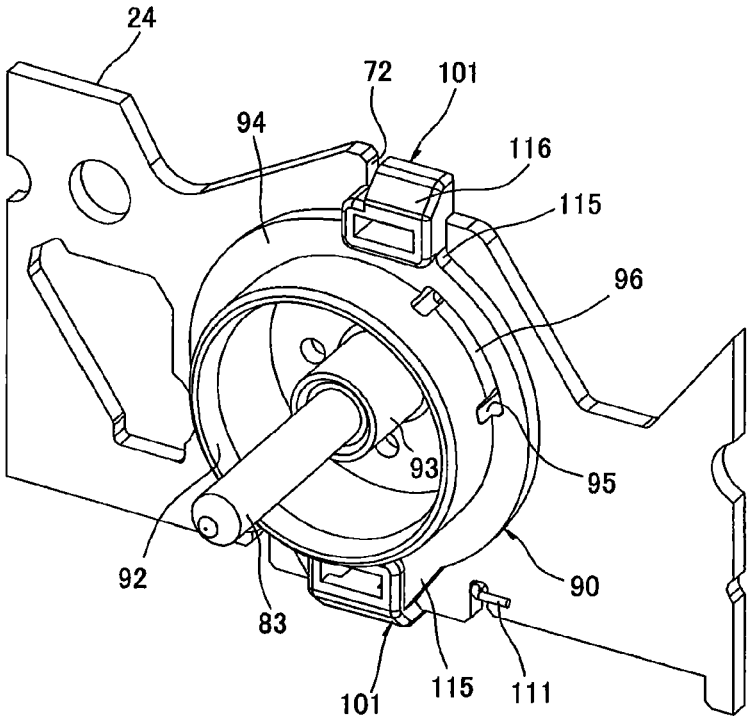
FIG. 11 is a perspective view illustrating the right shaft-receiving member mounted in the right inner plate.

The right shaft-receiving member 90 fitted around the right end of the photosensitive drum 5 is subsequently mounted in the corresponding drum support hole 32 formed in the right inner plate 24, as illustrated in FIG. 11. Specifically, the photosensitive drum 5 is positioned so that the seal part 98 of the right shaft-receiving member 90 opposes the drum support hole 32 from the left side thereof. Next, the entire photosensitive drum 5 is moved rightward so that the right shaft-receiving member 90 is inserted into the drum support hole 32, with the outer peripheral surface of the cylinder part 92 contacting the four straight parts 60 formed in the drum support hole 32. At this time, the sloped surfaces 118 formed on the engaging protrusions 117 of the first engaging parts 101 respectively contact the top edge (engagement part 72) and bottom edge (shaft-receiving engaging groove 70) of the right inner plate 24 from the left side thereof. As the right shaft-receiving member 90 continues to move rightward, the top and bottom edges of the right inner plate 24 slide over the corresponding sloped surfaces 118 and elastically deform the engaging protrusions 117 outward in the direction that the edges contact the sloped surfaces 118. When the collar part 94 contacts the left side surface of the right inner plate 24, further rightward movement of the right shaft-receiving member 90 is restricted. At this point, the top and bottom edges of the right inner plate 24 have slid over the sloped surfaces 118, allowing the engaging protrusions 117 to return to their original shape and leaving the edges of the right inner plate 24 between the corresponding sloped surfaces 118 and the collar part 94. Accordingly, the two first engaging parts 101 engage the engagement part 72 and shaft-receiving engaging groove 70 of the right inner plate 24.

When the two first engaging parts 101 engage the engagement part 72 and shaft-receiving engaging groove 70 of the right inner plate 24, the cylinder part 92 contacts the four straight parts 60 of the drum support hole 32, thereby being fixed to the right inner plate 24, while gaps are formed between the outer peripheral surface of the cylinder part 92 and the curved parts 61 of the drum support hole 32 to accept the thermal extension of the right inner plates 24.

Figure 13:
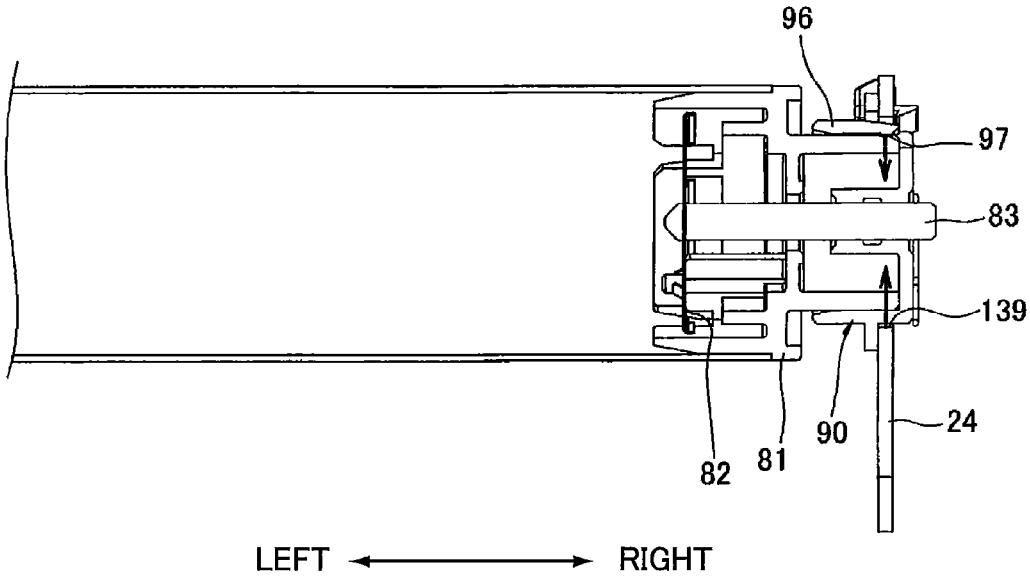
FIG. 13 is a cross-sectional view taken along a pressing direction illustrating the pressure of a pressing member on the right shaft-receiving member.

Further, when the two first engaging parts 101 engage the engagement part 72 and shaft-receiving engaging groove 70 of the right inner plate 24, the pressing member 96 (protruding part 97) is pressed inward of the cylinder part 92 by the inner peripheral surface 139. As the result, the right flange member 81 is pressed toward the curved part 61*a* positioned between the rear vertical straight part 63*b* and the bottom horizontal straight part 64*b* by the pressing member 96 and contacts the inner surface of the cylinder part 92. At the same time, the cylinder part 92 is also pressed toward between the rear vertical straight part 63*b* and the bottom horizontal straight part 64*b*. In this state, as shown in FIG. 13, the protruding part 97 is opposed to the inner peripheral surface 139 of the drum support hole 32 formed in the right inner plate 24 when projected along the pressing direction of the pressing members 96.

Thus, the right flange member 81 is positioned relative to the right inner plate 24 through the cylinder part 92, thereby achieving proper positioning of the right end portion of the photosensitive drum 5. Note that the right flange member 81 (photosensitive drum 5) can rotate, although the right flange member 81 is sandwiched between the pressing member 96 and the inner surface of the cylinder part 92.

Figure 12:
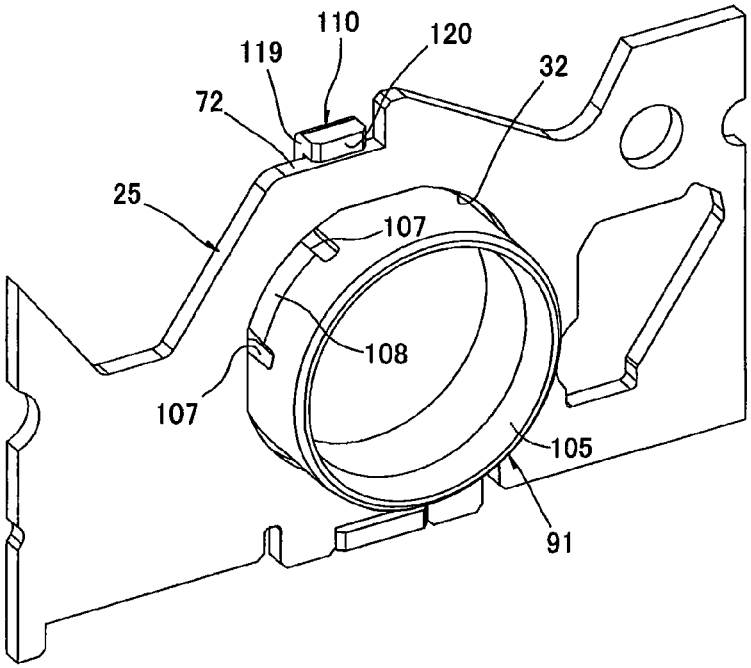
FIG. 12 is a perspective view illustrating the left shaft-receiving member mounted in the left inner plate.

Next, the left shaft-receiving member 91 is mounted in the left inner plate 25 and on the left end of the photosensitive drum 5 (the left flange member 81), as shown in FIG. 12. Specifically, with the flange member 81 exposed from the drum support hole 32 of the left inner plate 25, the cylinder part 105 of the left shaft-receiving member 91 is inserted between the outer peripheral surface of the flange member 81 and the drum support hole 32.

At this time, the protruding part 109 of the pressing member 108 formed in the cylinder part 105 elastically contacts the outer peripheral surface of the flange member 81, pressing the entire flange member 81 away from the pressing member 108. Contrary, the pressing member 108 is pressed by the left flange member 81 and protrudes outward of the cylinder part 105 due to the resistance from the flange member 81.

As with the right shaft-receiving member 90 described above, the cylinder part 105 of the left shaft-receiving member 91 is inserted into the drum support hole 32 with the outer peripheral surface of the cylinder part 105 contacting the four straight parts 60 inside the drum support hole 32.

At the same time, the collar part 106 of the left shaft-receiving member 91 is in contact with the outer surface (left side surface) of the left inner plate 25 when the left shaft-receiving member 91 has been completely mounted in the drum support hole 32. This contact restricts the left shaft-receiving member 91 from moving any further rightward, positioning the left shaft-receiving member 91 in the left-to-right direction (the axial direction of the photosensitive drum 5). Further, the top engaging protrusion 120 contacts the top edge of the left inner plate 25 (the engagement part 72) from above, while the bottom engaging protrusion 120 contacts the bottom edge of the left inner plate 25 (the shaft-receiving engaging groove 70) from below, as shown in FIG. 12. Accordingly, the two second engaging parts 110 engage the shaft-receiving engaging groove 70 and engagement part 72 of the left inner plate 25, thereby holding the left shaft-receiving member 91 in its left-to-right position.

When the two second engaging parts 110 engage the engagement part 72 and shaft-receiving engaging groove 70 of the left inner plate 25, the cylinder part 105 contacts the four straight parts 60 of the drum support hole 32, thereby being fixed to the left inner plate 25, while gaps are formed between the outer peripheral surface of the cylinder part 105 and the curved parts 61 of the drum support hole 32 to accept the thermal extension of the right inner plates 24.

Figure 14:
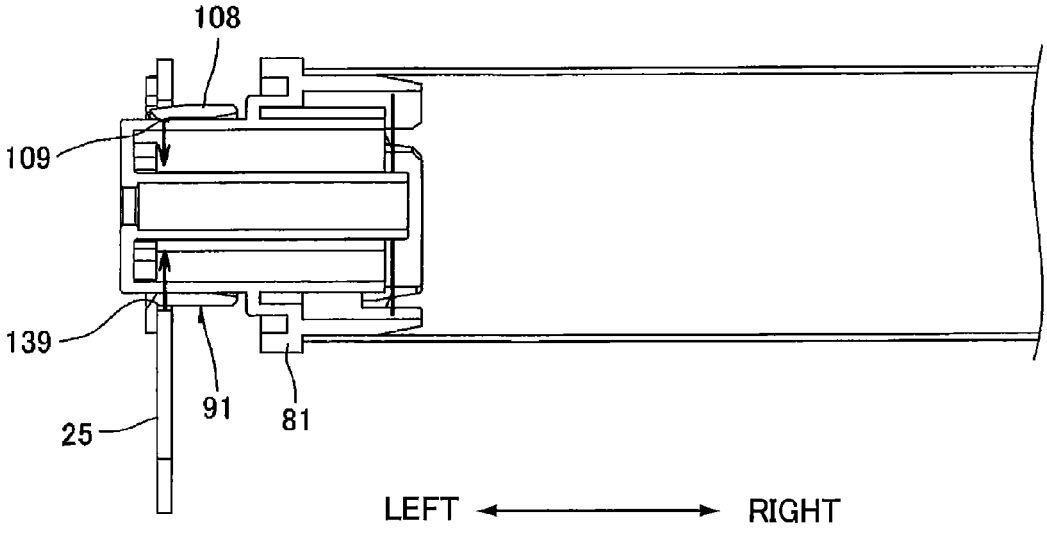
FIG. 14 is a cross-sectional view taken along a pressing direction illustrating the pressure of a pressing member on the left shaft-receiving member.

Further, when the two second engaging parts 110 engage the engagement part 72 and shaft-receiving engaging groove 70 of the left inner plate 25, the pressing member 108 (protruding part 109) is pressed inward of the cylinder part 105 by the inner peripheral surface 139. As the result, the left flange member 81 is pressed toward the curved part 61*a* positioned between the rear vertical straight part 63*b* and the bottom horizontal straight part 64*b* by the pressing member 108 and contacts the inner surface of the cylinder part 105. At the same time, the cylinder part 105 is also pressed toward between the rear vertical straight part 63*b* and the bottom horizontal straight part 64*b*. In this state, as shown in FIG. 14, the protruding part 109 is opposed to the inner peripheral surface 139 of the drum support hole 32 formed in the left inner plate 25 when projected along the pressing direction of the pressing member 108.

Thus, the left flange member 81 is positioned relative to the left inner plate 25 through the cylinder part 105, thereby achieving proper positioning of the left end portion of the photosensitive drum 5. Note that the left flange member 81 (photosensitive drum 5) can rotate, although the left flange member 81 is sandwiched between the pressing member 106 and the inner surface of the cylinder part 105.

Next, as shown in FIG. 6, a clip member 111 is attached to the portion of the shaft 83 that protrudes further rightward than the seal part 98 of the right shaft-receiving member 90. The clip member 111 is substantially U-shaped. The ends of the U-shaped clip member 111 are bent and engaged respectively in the clip grooves 71 of the right inner plate 24, while the midpoint of the clip member 111 contacts the portion of the shaft 83 protruding rightward from the seal part 98. Attaching the clip member 111 completes the operation for mounting the photosensitive drum 5 in the drum unit 3.

After all four photosensitive drums 5 have been mounted in the drum unit 3, the left and right outer plates 27 and 28 are disposed on the respective left and right outer sides of the left and right inner plates 24 and 25. The left and right outer plates 27 and 28 are assembled to the left and right inner plates 24 and 25, the front beam 21, the drum subunits 20, and the rear beam 22 by screws (not shown), thereby completing assembly of the drum unit 3.

(9) Mounting Developer Cartridges in the Drum Unit

After the drum unit 3 has been assembled, the developer cartridges 7 corresponding to each color used by the printer 1 can be mounted in the drum unit 3. As shown in FIG. 2, guide grooves 113 are formed on the inner surfaces of the left and right outer plates 27 and 28. Four of the guide grooves 113 are formed in each of the left and right outer plates 27 and 28 at regular intervals in the front-to-rear direction. Each guide groove 113 is configured of a pair of ridges formed on the inner surfaces of the left and right outer plates 27 and 28 that extend from the top edge of the surface toward the photosensitive drum 5. The developer cartridge 7 is mounted in the drum unit 3 by guiding the developer cartridge 7 downward along this pair of ridges.

Figure 15:
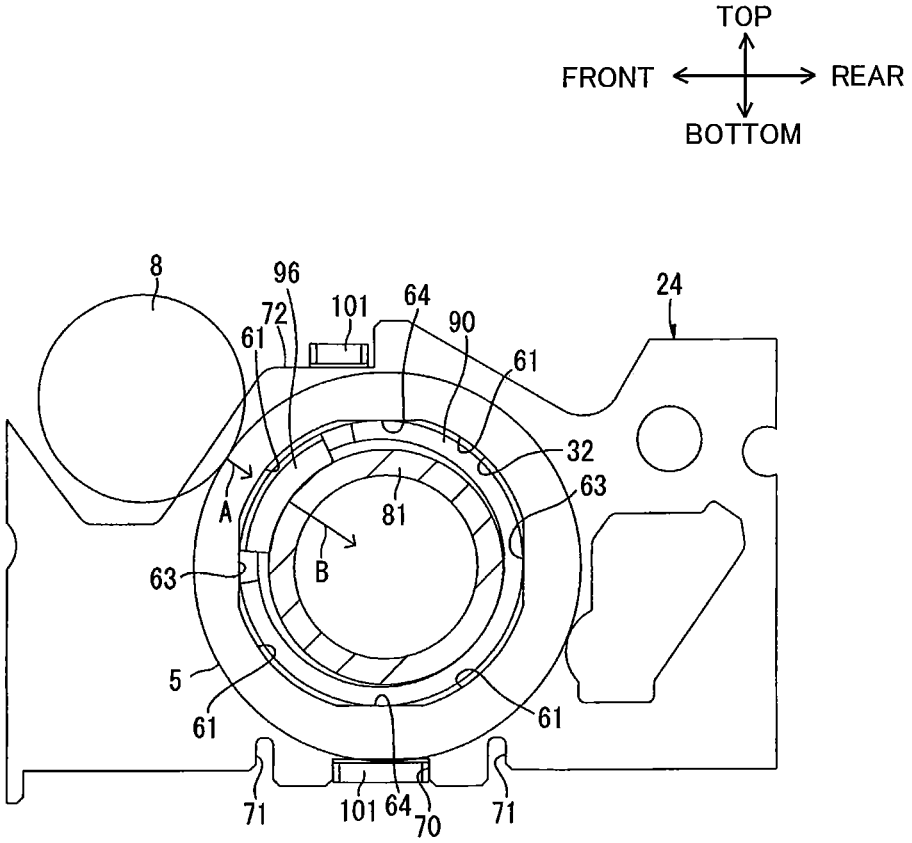
FIG. 15 is a side view showing the positional relationship of a developing roller and photosensitive drum when the developer cartridge is mounted in the drum unit.

As shown in FIG. 15, the direction in which the developer cartridge 7 is moving just before the developer cartridge 7 is completely mounted in the drum unit 3 is the same as a pressing direction B in which the flange members 81 are pressed by the pressing members 96 and 108. Therefore, a contact direction A in which the peripheral surface of the developing roller 8 provided in the developer cartridge 7 contacts the peripheral surface of the photosensitive drum 5 is also the same as the pressing direction B.

3. Grounding the Photosensitive Drums

As shown in FIG. 13, a ground member 82 is provided on the right end of the photosensitive drum 5 inside the main drum body 80 (see FIG. 6). The ground member 82 is disc-shaped, extending in a plane orthogonal to the axis of the main drum body 80 and contacts the inner peripheral surface of the main drum body 80.

When the right shaft-receiving member 90 has been attached to the right flange member 81, the shaft 83 provided on the right shaft-receiving member 90 is inserted inside the photosensitive drum 5 and contacts the ground member 82. Through this structure, the photosensitive drum 5 and the shaft 83 are electrically connected. As shown in FIG. 6, the clip member 111 is attached to the right end of the shaft 83. Since the ends of the clip member 111 are engaged in the clip grooves 71 formed in the right inner plate 24, the shaft 83 and the right inner plate 24 are also electrically connected. Hence, the main drum body 80 of the photosensitive drum 5 is electrically connected with and can conduct electricity to the right inner plate 24 through the ground member 82, shaft 83, and clip member 111.

When the drum unit 3 is mounted in the main casing 2, as shown in FIG. 1, the main casing reference shaft 34 is fitted into the positioning parts 53 of the left and right inner plates 24 and 25 (see FIG. 4) and is capable of grounding the left and right inner plates 24 and 25. Since the right inner plate 24, photosensitive drums 5, and ground members 82 are electrically connected through the shafts 83 and clip members 111, the photosensitive drums 5 can be ground through the ground members 82, shafts 83, clip members 111, right inner plate 24, and main casing reference shaft 34.

4. Main Casing (1) Mounting the Drum Unit in and Removing the Drum Unit from the Main Casing To mount the drum unit 3 in the main casing 2, first the cover 4 on the main casing 2 shown in FIG. 1 is opened. The drum unit 3 is then inserted rearward into the main casing 2 and is guided therein. When the positioning parts 53 formed in the left and right inner plates 24 and 25 contact the main casing reference shaft 34, the drum unit 3 is restricted from being pushed further rearward and at this point is completely mounted inside the main casing 2.

To remove the drum unit 3 from the main casing 2, the above procedure is performed in reverse.

(2) Inputting a Drive Force for the Photosensitive Drums

As shown in FIG. 2, drive transmission parts 112 for transmitting a drive force to the photosensitive drums are provided inside the main casing 2 at positions opposing the left ends of the photosensitive drums 5 in the left-to-right direction when the drum unit 3 is mounted in the main casing 2. After the drum unit 3 is mounted in the main casing 2, the drive transmission parts 112 are advanced rightward and couple with coupling grooves (not shown) provided in the left endface of each left flange member 81. With this construction, a drive force can be transmitted from the drive transmission parts 112 to the respective photosensitive drums 5 for driving the photosensitive drums 5 to rotate.

After the drive transmission parts 112 are connected to the coupling grooves formed in the flange members 81, the drive transmission parts 112 are advanced further rightward, whereby the entire drum unit 3 is moved rightward through the flange members 81. In this way, positioning of the drum unit 3 in the left-to-right direction can be achieved.

5. Operations and Effects of the First Embodiment (1) As described above, the cylinder part 92 is fixed to the right inner plate 24 and the left inner plate 25 by the four straight parts 60 of the drum support hole 32. Further, the right and left flange members 81 are firstly fitted into the right and left shaft-receiving members 90 and 91 with play, and are secondly positioned through pressure by the pressing members 96 and 108. Hence, the right and the left flange members 81 are positioned relative to the right inner plate 24 and the left inner plate 25 through the cylinder part 92 and 105, respectively.

Thus, this play (margin) between the flange members 81 and the right and left shaft-receiving members 90 and 91 can absorb any difference in thermal expansion occurring between the right and left inner plates 24 and 25. Therefore, even if the right inner plate 24 and the left inner plate 25 have differing degrees of thermal expansion, the right and the left flange members 81 are positioned relative to the right inner plate 24 and the left inner plate 25 through the cylinder part 92, respectively. As the result, the influence of the thermal expansion is restrained. Consequently, the photosensitive drums 5 can be positioned relative to the right inner plate 24 and the left inner plate 25, respectively, with precision, thereby maintaining the four photosensitive drums 5 parallel to one another, regardless of the ambient temperature. Accordingly, this construction can prevent image-forming irregularities, such as problems with color registration.

Further, since the cylinder parts 92 and 105 are also pressed toward a stable position formed between the rear vertical straight part 63*b* and the bottom horizontal straight part 64*b*, the right and left flange members 81 are positioned relative to the right inner plate 24 and the left inner plate 25 through the cylinder part 92, respectively, more precisely.

Further, when projected along the pressing directions of the respective pressing members 96 and 108, the protruding parts 97 and 109 formed on the pressing members 96 and 108 are opposed to the inner peripheral surfaces 139 of the respective drum support holes 32 formed in the left and right inner plates 24 and 25.

Accordingly, as illustrated in FIGS. 13 and 14, the force of pressure applied by the pressing members 96 and 108 is equal to the force of resistance by the left and right inner plates 24 and 25 in the pressing direction of the pressing members 96 and 108, thereby avoiding bending of the left and right shaft-receiving members 91 and 90.

Thus, this construction can accurately position the photosensitive drum 5 relative to the left and right inner plates 24 and 25.

(2) Further, the protruding part 97 (109) is formed in the rectangular part surrounded by the notch part 95 (107), and specifically on the end of the rectangular part nearest the right inner plate 24 (left inner plate 25) side. Forming this pressing member 96 (109) through such a simple construction can reduce manufacturing costs of the printer 1. Further, since the pressing member 96 (109) is formed integrally with the right shaft-receiving member 90 (left shaft-receiving member 91), this construction can use fewer parts than a structure that forms the pressing members 96 (109) and right shaft-receiving member 90 (left shaft-receiving member 91) separately.

(3) The right shaft-receiving member 90 (left shaft-receiving member 91) is also provided with the annular collar part 94 (106). The collar part 94 (106) contacts the inner surface (left surface) of the right inner plate 24 (the inner surface (right surface) of the left inner plate 25) when the right shaft-receiving member 90 (left shaft-receiving member 91) is fitted into the drum support hole 32, thereby determining the position of the right shaft-receiving member 90 (left shaft-receiving member 91) in the left-to-right direction. The first engaging parts 101 are also integrally formed with the collar part 94 (106). The first engaging parts 101 engage the shaft-receiving engaging groove 70 and engagement part 72 of the right inner plate 24 (left inner plate 25) to hold the right shaft-receiving member 90 (left shaft-receiving member 91) in its left-to-right position.

(4) The drive transmission parts 112 are also provided in the main casing 2 on the left side of the photosensitive drums 5 at positions opposing the left ends of the left flange members 81 relative to the left-to-right direction. Coupling grooves (not shown) that connect with the drive transmission parts 112 are provided in the left endfaces of the left flange members 81. By coupling the drive transmission parts 112 with the coupling grooves, a drive force can be transmitted to the photosensitive drums 5 through the drive transmission parts 112 for driving the photosensitive drums 5 to rotate.

(5) When a developer cartridge 7 is mounted in the drum unit 3, the outer peripheral surface of the developing roller 8 provided in the developer cartridge 7 presses against the photosensitive drum 5 in the contact direction A shown in FIG. 15. The pressing members 96 and 108 press the flange members 81 in the pressing direction B equivalent to the contact direction A. Hence, both the developing roller 8 and the pressing members 96 and 108 apply a force to the flange members 81, enabling the flange members 81 to be positioned more precisely relative to the left and right inner plates 24 and 25.

6. Second Embodiment

Next, a second embodiment of the present invention will be described with reference to FIGS. 16 through 20.

In FIGS. 16 through 20, like parts and components to those described in the first embodiment shown in FIGS. 1 through 15 are designated with the same reference numerals to avoid duplicating description.

(1) Left Shaft-Receiving Member

In the first embodiment, the pressing member 108 is configured of the portion of the cylinder part 105 surrounded by the notch part 107, as shown in FIGS. 9 and 10.

Figure 16:
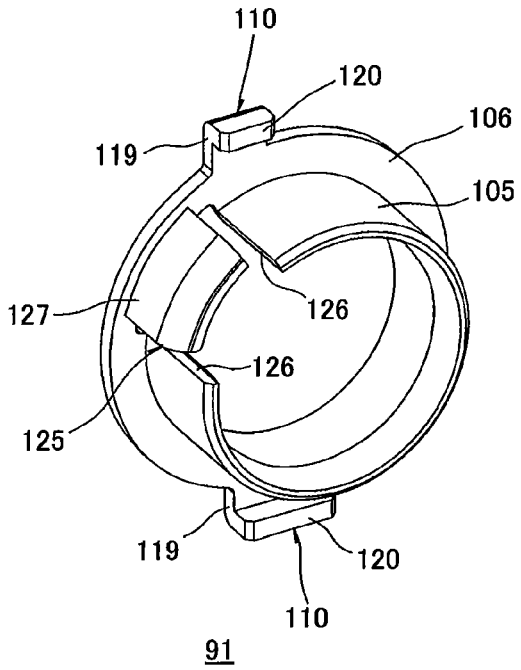
FIG. 16 is a perspective view of a left shaft-receiving member according to a second embodiment of the present invention.
Figure 17:
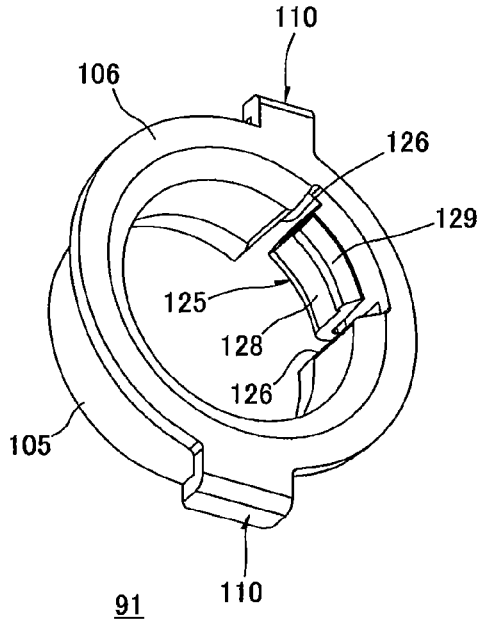
FIG. 17 is a perspective view of a left shaft-receiving member according to a second embodiment of the present invention.

However, the left shaft-receiving member 91 according to the second embodiment is provided with a pressing member 125, as shown in FIGS. 16 and 17. The pressing member 125 has a U-shape including a first stem 127, and a second stem 128. The first stem 127 of the pressing member 125 constitutes a portion of the cylinder part 105 interposed between a pair of slits 126. The second stem 128 is a portion folded back over the first stem 127.

More specifically, the slits 126 are formed parallel to each other in the cylinder part 105 and separated by a distance in the circumferential direction of the cylinder part 105, as shown in FIGS. 16 and 17. The slits 126 cut out in the cylinder part 105 extend toward the collar part 106 from the edge of the cylinder part 105 opposite the collar part 106.

Figure 20:
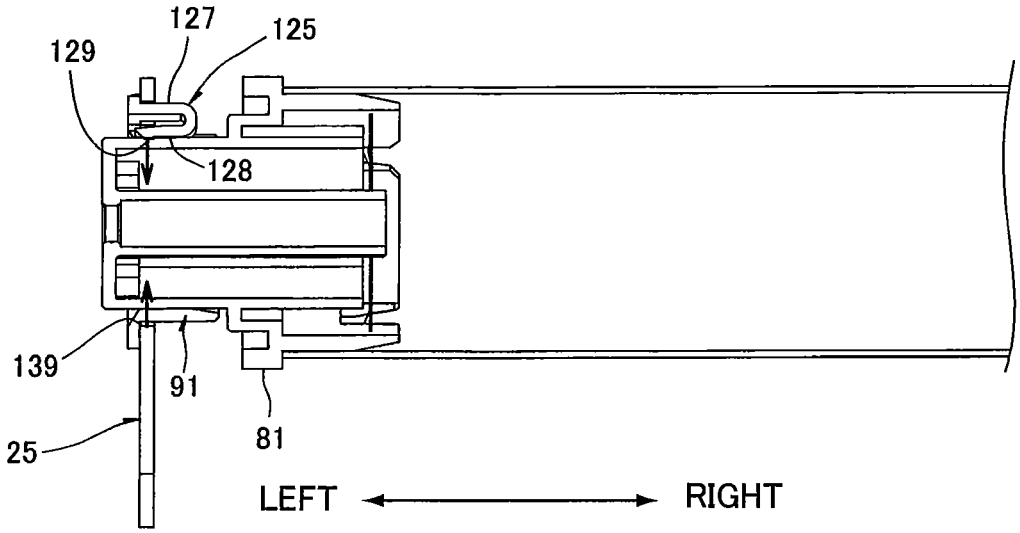
FIG. 20 is a cross-sectional view taken along a pressing direction illustrating the pressure of a pressing member on the left shaft-receiving member.

The pressing member 125 has a substantially U-shaped cross section (see FIG. 20). The first stem 127 of the pressing member 125 constitutes the portion of the cylinder part 105 interposed between the slits 126 that extends from the collar part 106 to a midway point in the cylinder part 105 relative to the axial direction thereof. The second stem 128 of the pressing member 125 is formed by bending the free end of the cylinder part 105 interposed between the slits 126 at a midway point in the axial direction of the cylinder part 105 so that the free end overlaps the first stem 127 in the thickness direction. The second stem 128 is elastically deformed when bent at this midway point.

A protruding part 129 is formed on the inner surface of the second stem 128 along the edge nearest the collar part 106. The protruding part 129 has a hook-shaped cross section (see FIG. 20). The protruding part 129 protrudes inward from the inner surface of the second stem 128 along the collar part 106 side into the interior space of the cylinder part 105. When the left shaft-receiving member 91 is fitted around the flange member 81, the protruding part 109 contacts and applies pressure to the flange member 81 (see FIG. 20).

(2) Drum Support Holes

Figure 18:
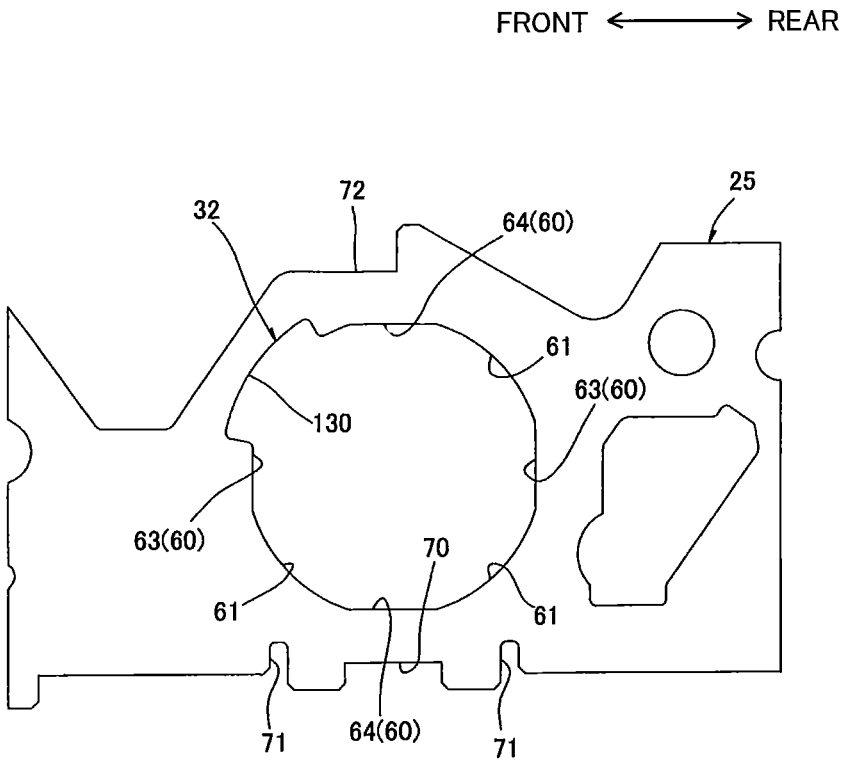
FIG. 18 is an enlarged view of the left inner plate around a drum support hole according to the second embodiment.

The left shaft-receiving member 91 is fitted into a drum support hole 32 according to a second embodiment having the structure shown in FIG. 18. Specifically, the upper portion of the front vertical straight part 63 and the curved part 61 on the upper front side have been cut outward from the inner peripheral surface of the drum support hole 32. The resulting part cut out in the inner surface of the drum support hole 32 constitutes a pressing member accommodating part 130.

(3) Mounting the Left Shaft-Receiving Member in the Left Inner Plate and on the Photosensitive Drum The left shaft-receiving member 91 described above is mounted in the left inner plate 25 and over the left end of the photosensitive drum 5 (the left flange member 81). Specifically, with the left flange member 81 exposed from the drum support hole 32 of the left inner plate 25, the cylinder part 105 of the left shaft-receiving member 91 is inserted between the outer peripheral surface of the left flange member 81 and the drum support hole 32.

Figure 19:
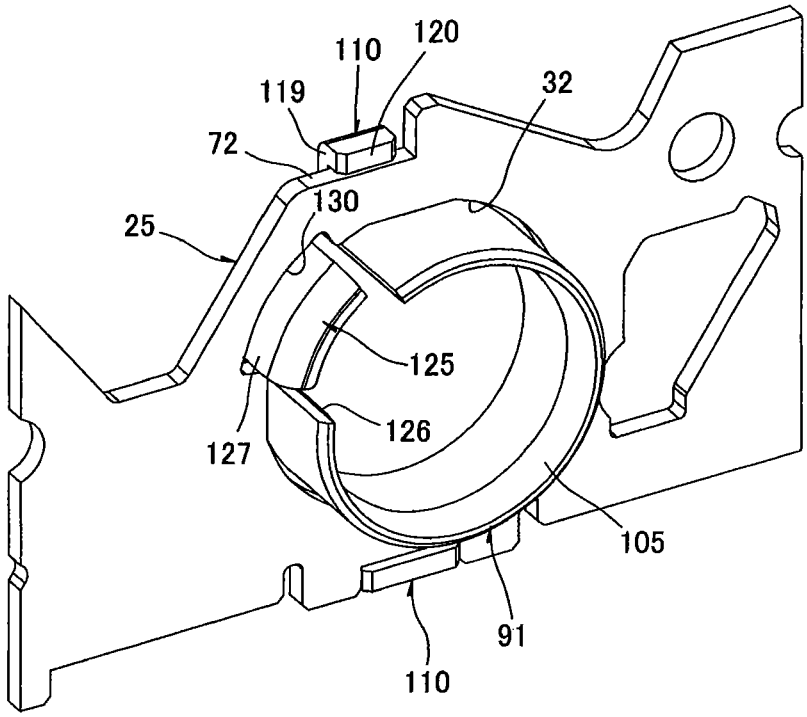
FIG. 19 is a perspective view illustrating the left shaft-receiving member mounted in the left inner plate.

At this time, the pressing member 125 is accommodated in the pressing member accommodating part 130 provided in the left inner plate 25, as shown in FIG. 19. Here, the outer peripheral surface of the first stem 127 constituting the pressing member 125 opposes the inner peripheral surface of the pressing member accommodating part 130.

As shown in FIG. 20, the protruding part 129 of the second stem 128 elastically contacts the outer peripheral surface of the flange member 81, pressing the entire flange member 81 away from the pressing member 125. When the protruding part 129 of the second stem 128 is projected in the pressing direction of the pressing member 125, the protruding part 129 is aligned with the inner peripheral surface 139 of the corresponding drum support hole 32 formed in the left inner plate 25.

(4) Operations and Effects of the Second Embodiment

Since the pressing member 125 is elastically deformed when bending the pressing member 125 at the midway point, the pressing member 125 can apply stronger pressure than the pressing member 108 of the first embodiment to the left flange member 81 toward the curved part 61 between the first and second flat parts (the rear vertical straight part 63 and bottom horizontal straight part 64). Therefore, the flange member 81 can be precisely positioned relative to the first and second flat surfaces with the outer peripheral surface of the flange member 81 contacting the inner peripheral surface of the left shaft-receiving member 91, thereby achieving precise positioning of the flange member 81 in both vertical and front-to-rear directions.

When the protruding part 129 of the second stem 128 is projected along the pressing direction of the pressing member 125, the protruding part 129 overlaps the inner peripheral surface 139 formed in the drum support hole 32 of the left inner plate 25. Hence, as shown in FIG. 20, the force with which the pressing member 125 presses against the flange member 81 is equal to the force of resistance by the left inner plate 25 in the pressing direction of the pressing member 125, thereby preventing the left shaft-receiving member 91 from bending.

The construction according to the second embodiment of the present invention can position the photosensitive drum 5 more accurately relative to the left inner plate 25 than the construction of the first embodiment described above.

The second embodiment described above gives one application of the present invention, but the present invention can be implemented by variations of this embodiment.

For example, the left shaft-receiving member 91 according to the second embodiment is provided with the pressing member 125 having the first stem 127 and second stem 128. However, a pressing member with a similar structure may be provided on the right shaft-receiving member 90.

7. Third Embodiment

Next, a third embodiment of the present invention will be described.

In FIGS. 21 through 25, like parts and components to those described in the first embodiment shown in FIGS. 1 through 15 are designated with the same reference numerals to avoid duplicating description.

(1) Left Shaft-Receiving Member

In the first embodiment, the pressing member 108 is configured of the portion of the cylinder part 105 surrounded by the notch part 107, as shown in FIGS. 9 and 10.

Figure 21:
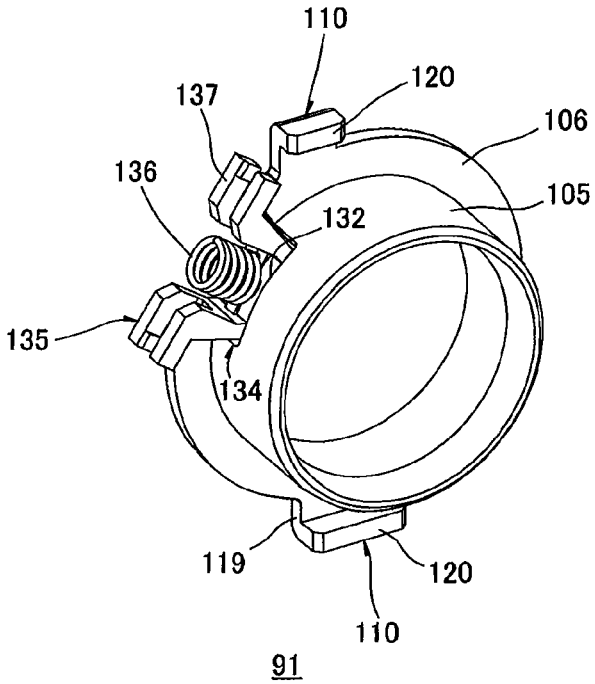
FIG. 21 is a perspective view of a left shaft-receiving member according to a third embodiment of the present invention.
Figure 22:
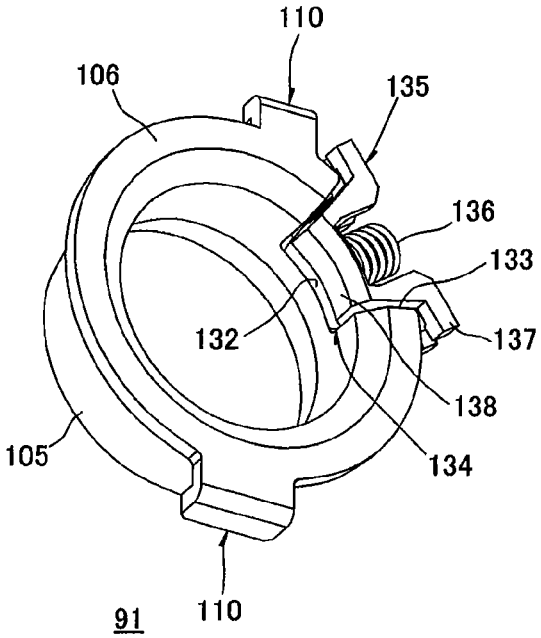
FIG. 22 is a perspective view of a left shaft-receiving member according to a third embodiment of the present invention.

However, the left shaft-receiving member 91 according to the third embodiment has a notch part 134, and a pressing member 135, as shown in FIGS. 21 and 22. The notch part 134 is formed by cutting out a portion of the left shaft-receiving member 91 along the circumferential direction and at a prescribed width. The pressing member 135 is disposed in the notch part 134. The pressing member 135 includes a spring member 136.

More specifically, the notch part 134 is formed continuously of a first notch part 132, and a second notch part 133. The first notch part 132 is cut out in the collar part 106 side of the cylinder part 105 with an arc length having a central angle of about 30 degrees. The second notch part 133 is also cut radially outward in the collar part 106 with an arc length having a central angle of about 30 degrees, so that the second notch part 133 is in communication with the first notch part 132.

The pressing member 135 is integrally formed of a pressing part 138, and support parts 137.

The pressing part 138 is formed in a curved shape having the same curvature as the inner peripheral surface of the cylinder part 105. The pressing part 138 appears substantially rectangular when viewed along the radial direction.

A pair of the support parts 137 is provided one on each end of the pressing part 138 with respect to the axial direction of the pressing member 135. The support parts 137 are separated from each other and grip the collar part 106. Specifically, each support part 137 has two ends extending radially outward from the ends of the pressing part 138 with respect to the circumferential direction of the same, then bending away from each other tangentially to the collar part 106.

The pressing member 135 is fitted into the notch part 134, with the pressing part 138 confronting the interior space defined by the cylinder part 105. In this state, end faces of the pressing part 138 relative to its circumferential direction and the support parts 137 each oppose the notch part 134 with a slight gap formed therebetween.

The spring member 136 is provided on the outer surface of the pressing part 138 relative to the radial direction of the cylinder part 105 and is interposed between the pair of support parts 137.

(2) Drum Support Holes

Figure 23:
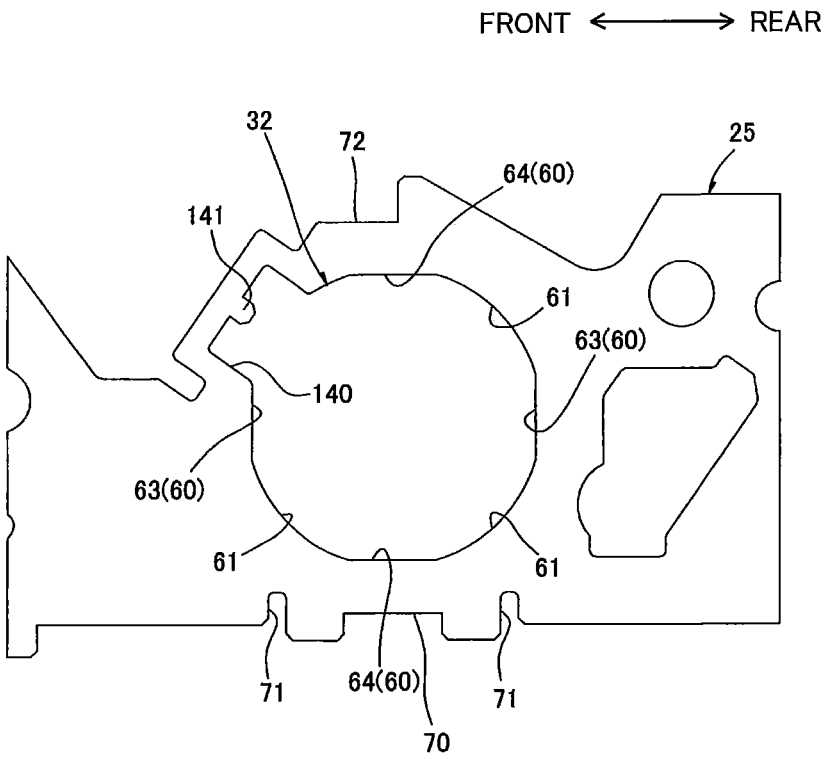
FIG. 23 is an enlarged view of the left inner plate according to the third embodiment of the present invention around the drum support hole.
Figure 24:
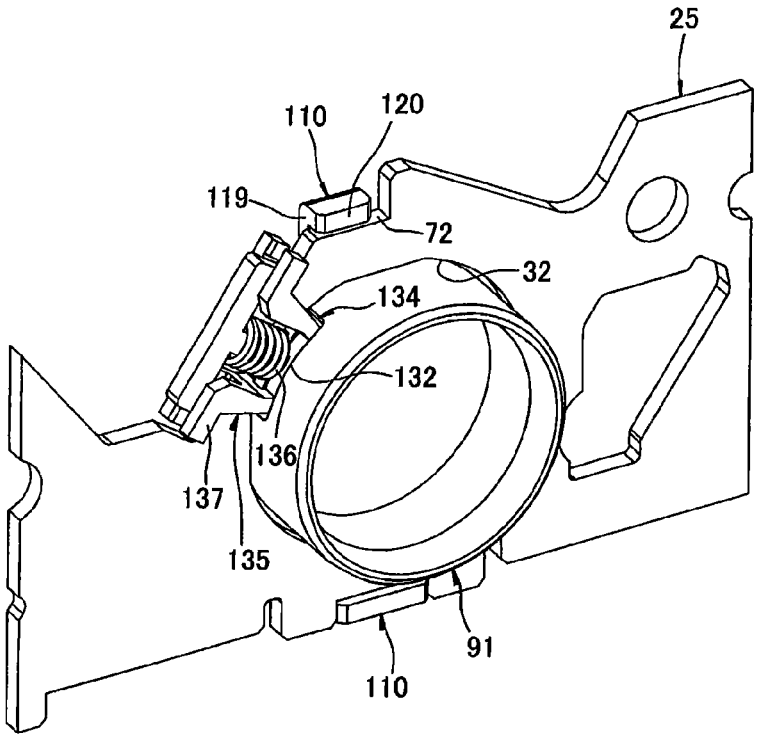
FIG. 24 is a perspective view illustrating the left shaft-receiving member mounted in the left inner plate.

The left shaft-receiving member 91 is fitted into a drum support hole 32 according to a third embodiment having the structure shown in FIG. 23. Specifically, the curved part 61 on the upper front side is projected further outward and forms a general U-shape in the inner peripheral surface of the drum support hole 32 when viewed from the side. The resulting cutout part in the inner surface of the drum support hole 32 constitutes a spring accommodating part 140.

A spring guide 141 is formed in the center of the edge defining the spring accommodating part 140 so as to protrude into the interior space of the drum support hole 32.

(3) Mounting the Left Shaft-Receiving Member in the Left Inner Plate and on the Photosensitive Drum The left shaft-receiving member 91 described above is mounted in the left inner plate 25 and over the left end of the photosensitive drum 5 (the left flange member 81). Specifically, the first the spring member 136 is mounted over the spring guide 141. The pressing member 135 is disposed in the notch part 134 so as to press against the spring member 136, while the support parts 137 pinch the spring accommodating part 140 in the thickness direction and the pressing part 138 opposes the spring guide 141. Next, with the left flange member 81 exposed from the drum support hole 32 of the left inner plate 25, the cylinder part 105 of the left shaft-receiving member 91 is inserted between the outer peripheral surface of the left flange member 81 and the drum support hole 32.

At this time, the pressing part 138 of the pressing member 135 contacts the outer peripheral surface of the flange member 81 through the notch part 134 and is pressed against the flange member 81 by the urging force of the spring member 136. Accordingly, the entire flange member 81 is pushed away from the pressing member 135.

When the pressing part 138 of the pressing member 135 is projected in the pressing direction of the pressing member 135, the pressing part 138 is aligned with the inner peripheral surface 139 of the corresponding drum support hole 32 formed in the left inner plate 25.

(4) Operations and Effects of the Third Embodiment

By the urging force of the spring member 136, the pressing member 135 presses the flange member 81 toward the curved part 61 positioned between the rear vertical straight part 63 and bottom horizontal straight part 64. Hence, the pressure applied by the pressing member 135 can be precisely adjusted based on the spring constant of the spring member 136.

With the left flange member 81 contacting the inner peripheral surface of the left shaft-receiving member 91, the flange member 81 is positioned relative to the first and second flat surfaces, thereby achieving positioning of the flange member 81 in the vertical and front-to-rear directions.

Figure 25:
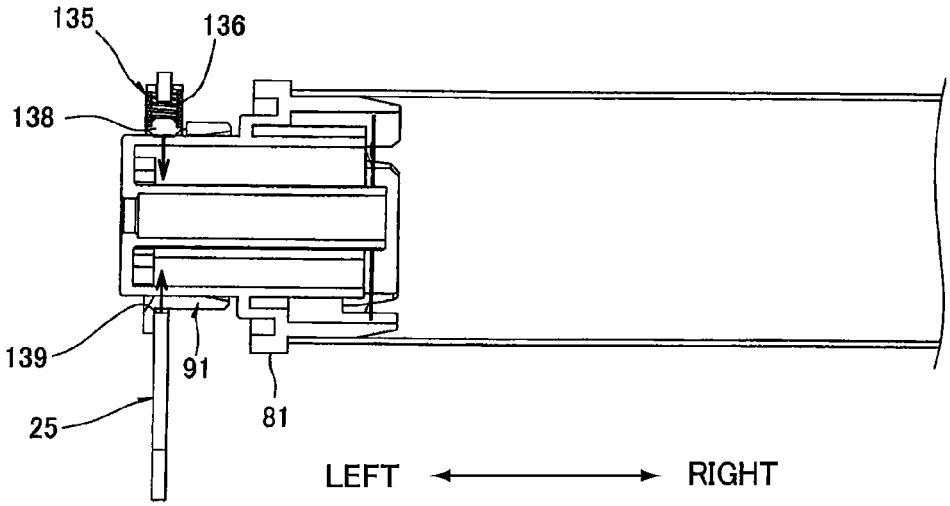
FIG. 25 is a cross-sectional view taken along the pressing direction illustrating the pressure of the pressing member on the left shaft-receiving member.

When the pressing part 138 of the pressing member 135 is projected in the pressing direction of the pressing member 135, the pressing part 138 is positioned opposite the inner peripheral surface 139 of the corresponding drum support hole 32 formed in the left inner plate 25. Hence, as shown in FIG. 25, the force with which the pressing member 135 presses against the flange member 81 is equal to the force of resistance by the left inner plate 25 in the pressing direction of the pressing member 135, thereby preventing the left shaft-receiving member 91 from bending.

The construction according to the third embodiment of the present invention can suitably adjust the force applied by the pressing member 135 and can accurately position the photosensitive drums 5 relative to the left inner plate 25.

The third embodiment described above gives one application of the present invention, but the invention can be implemented by variations of this embodiment.

While the invention has been described in detail with reference to the embodiments thereof, it would be apparent to those skilled in the art that various changes and modifications may be made therein without departing from the spirit of the invention.

For example, the left shaft-receiving member 91 according to the third embodiment is provided with the pressing member 135 having the spring member 136. However, a pressing member with a similar structure may be provided on the right shaft-receiving member 90.

Further, the flange member 81 may be pressed toward a part other than the curved part 61*a*.

What is claimed is:

1. A drum unit comprising:

a photosensitive drum having a rotational axis extending in a first direction and at least one end in the first direction;

a frame extending in a second direction perpendicular to the first direction and being formed with a through-hole having an inner peripheral surface;

a shaft-receiving device comprising:

a shaft-receiving portion configured to receive insertion of the one end in the first direction, and to be inserted into the through-hole in the first direction and opposing the inner peripheral surface in the second direction, and a pressing member opposing the inner peripheral surface in the second direction and configured to press the photosensitive drum toward the inner peripheral surface; and a flange member provided at the one end of the photosensitive drum, the pressing member being configured to press the flange member toward the inner peripheral surface.

2. The drum unit according to claim 1, wherein the shaft-receiving portion has a cylinder shape extending in the first direction, one part of the shaft-receiving portion being cut out to form an opening, the pressing member being disposed in the opening, and wherein the pressing member has a U-shape having a first stem and a second stem opposing the first stem in the second direction.

3. The drum unit according to claim 1, wherein the pressing member is a spring.

4. The drum unit according to claim 1, further comprising a developing roller, wherein the photosensitive drum is configured to press the developing roller in the second direction.

5. The drum unit according to claim 1, wherein the shaft-receiving device further comprises:

a collar part disposed along the frame; and an engaging part that is integrally-formed with the collar part to engage with the frame.

6. The drum unit according to claim 1, further comprising a gear provided at the end of the photosensitive drum to transmit a driving force to the photosensitive drum.

7. The drum unit according to claim 1, wherein the photosensitive drum includes a plurality of photosensitive drums, and wherein a plurality of through-holes corresponding to the plurality of photosensitive drums is formed in the frame.

8. The drum unit according to claim 1, wherein the inner peripheral surface has a first surface extending in a third direction and a second surface extending in a fourth direction different from the third direction, and wherein the pressing member is configured to press the flange member toward a position between the first surface and the second surface.

9. A drum unit comprising:

a photosensitive drum having a rotational axis extending in a first direction and at least one end in the first direction;

a frame extending in a second direction perpendicular to the first direction and being formed with a through-hole having an inner peripheral surface; and a shaft-receiving device comprising:

a shaft-receiving portion configured to receive insertion of the one end in the first direction, and to be inserted into the through-hole in the first direction and opposing the inner peripheral surface in the second direction, and a pressing member opposing the inner peripheral surface in the second direction and configured to press the photosensitive drum toward the inner peripheral surface, wherein the shaft-receiving portion has a cylinder shape extending in the first direction, one part of the shaft-receiving portion being cut out to form a U-shaped opening, wherein a part of the shaft-receiving portion surrounded by the U-shaped opening constituting the pressing member, and wherein the pressing member has a protruding part that protrudes inward of the shaft-receiving portion to press the photosensitive drum toward the inner peripheral surface.

10. A drum unit comprising:

a photosensitive drum having a rotational axis extending in a first direction and at least one end in the first direction;

a frame extending in a second direction perpendicular to the first direction and being formed with a through-hole having an inner peripheral surface, wherein the inner peripheral surface has a first surface extending in a third direction and a second surface extending in a fourth direction different from the third direction; and a shaft-receiving device comprising:

a shaft-receiving portion configured to receive insertion of the one end in the first direction, and to be inserted into the through-hole in the first direction and opposing the inner peripheral surface in the second direction, and a pressing member opposing the inner peripheral surface in the second direction and configured to press the photosensitive drum toward a position between the first surface and the second surface of the inner peripheral surface.

11. An image-forming device comprising:

a photosensitive drum having a rotational axis extending in a first direction and at least one end in the first direction;

a frame extending in a second direction perpendicular to the first direction and being formed with a through-hole having an inner peripheral surface;

a shaft-receiving device comprising:

a shaft-receiving portion configured to receive insertion of the one end in the first direction, and to be inserted into the through-hole in the first direction and opposing the inner peripheral surface in the second direction, and a pressing member opposing the inner peripheral surface in the second direction to press the photosensitive drum toward the inner peripheral surface; and a flange member provided at the one end of the photosensitive drum, the pressing member being configured to press the flange member toward the inner peripheral surface.

12. The image-forming device according to claim 11, wherein the shaft-receiving portion has a cylinder shape extending in the first direction, one part of the shaft-receiving portion being cut out to form a U-shaped opening, a part of the shaft-receiving portion surrounded by the U-shaped opening constituting the pressing member, and wherein the pressing member has a protruding part that protrudes inward of the shaft-receiving portion to press the photosensitive drum toward the inner peripheral surface.

13. The image-forming device according to claim 11, wherein the shaft-receiving portion has a cylinder shape extending in the first direction, one part of the shaft-receiving portion being cut out to form an opening, the pressing member being disposed in the opening, and wherein the pressing member has a U-shape having a first stem and a second stem opposing the first stem in the second direction.

14. The image-forming device according to claim 11, wherein the pressing member is a spring.

15. The image-forming device according to claim 11, further comprising a developing roller, wherein the photosensitive drum is configured to press the developing roller in the second direction.

16. The image-forming device according to claim 11, wherein the shaft-receiving device further comprises:

a collar part disposed along the frame; and an engaging part that is integrally-formed with the collar part to engage with the frame.

17. The image-forming device according to claim 11, further comprising a gear provided at the end of the photosensitive drum to transmit a driving force to the photosensitive drum.

18. The image-forming device according to claim 11, wherein the photosensitive drum includes a plurality of photosensitive drums, and wherein a plurality of through-holes corresponding to the plurality of photosensitive drums is formed in the frame.

19. The image-forming device according to claim 11, wherein the inner peripheral surface has a first surface extending in a third direction and a second surface extending in a fourth direction different from the third direction, and wherein the pressing member is configured to press the flange member toward a position between the first surface and the second surface.

20. The image-forming device according to claim 11, wherein the inner peripheral surface has a first surface extending in a third direction and a second surface extending in a fourth direction different from the third direction, and wherein the pressing member is configured to press the photosensitive drum toward a position between the first surface and the second surface.

* * * * *